US008134531B2

(12) United States Patent
Osame et al.

(10) Patent No.: US 8,134,531 B2
(45) Date of Patent: Mar. 13, 2012

(54) SOURCE LINE DRIVING CIRCUIT, ACTIVE MATRIX TYPE DISPLAY DEVICE AND METHOD FOR DRIVING THE SAME

(75) Inventors: Mitsuaki Osame, Kanagawa (JP); Aya Miyazaki, Kanagawa (JP)

(73) Assignee: Semiconductor Energy Laboratory Co., Ltd., Atsugi-shi, Kangawa-ken (JP)

( * ) Notice: Subject to any disclaimer, the term of this patent is extended or adjusted under 35 U.S.C. 154(b) by 1195 days.

(21) Appl. No.: 11/905,850

(22) Filed: Oct. 4, 2007

(65) Prior Publication Data

US 2008/0094343 A1 Apr. 24, 2008

(30) Foreign Application Priority Data

Oct. 13, 2006 (JP) ..... 2006-280535

(51) Int. Cl.
*G09G 3/34* (2006.01)

(52) U.S. Cl. ..... 345/99; 345/55; 345/204; 345/690

(58) Field of Classification Search ..... 345/99, 345/55, 204, 690
See application file for complete search history.

(56) References Cited

U.S. PATENT DOCUMENTS

| | | | | |
|---|---|---|---|---|
| 5,287,095 | A | 2/1994 | Kitazima et al. | |
| 6,492,972 | B1 * | 12/2002 | Kubota et al. | 345/100 |
| 6,693,617 | B2 * | 2/2004 | Sasaki et al. | 345/98 |
| 7,148,872 | B2 | 12/2006 | Yamashita et al. | |
| 7,304,630 | B2 * | 12/2007 | Kobayashi et al. | 345/100 |
| 7,786,968 | B2 * | 8/2010 | Yokoyama et al. | 345/94 |
| 2006/0232543 | A1 | 10/2006 | Kobayashi et al. | |
| 2006/0262483 | A1 | 11/2006 | Osame | |

FOREIGN PATENT DOCUMENTS

| | | |
|---|---|---|
| JP | 61-048893 | 3/1986 |
| JP | 02-157794 | 6/1990 |
| JP | 2001-265289 | 9/2001 |
| JP | 2003-337320 | 11/2003 |
| JP | 2005-055632 | 3/2005 |

OTHER PUBLICATIONS

Invitation to pay additional fees (Application No. PCT/JP2007/069640) from the International Searching Authority dated Nov. 6, 2007.

* cited by examiner

*Primary Examiner* — Richard Hjerpe
*Assistant Examiner* — Leonid Shapiro
(74) *Attorney, Agent, or Firm* — Eric J. Robinson; Robinson Intellectual Property Law Office, P.C.

(57) ABSTRACT

If the frequency of a clock signal is increased, the pulse width of a sampling pulse is decreased, and the amount of time for a video signal to be written to a source line is inadequate. Sampling pulses (sam) rise sequentially in synchronization with the rise of a start pulse (SP). As the start pulse (SP) rises, synchronized with the rise of clock signals (CK, CKB), the sampling pulses (sam) fall off sequentially, delayed by half the period of the clock signals (CK, CKB) for every step. As a result, the sampling pulses (sam) with a pulse width longer than one period of the clock signals (CK, CKB) are generated. In a period $T_a$, a desired video signal (VIDEO) is written to its corresponding source line. In this way, the time for half a period of the clock signal can be secured for writing to the source line.

13 Claims, 17 Drawing Sheets

SOURCE LINE DRIVING CIRCUIT, ACTIVE MATRIX TYPE DISPLAY DEVICE AND METHOD FOR DRIVING THE SAME

TECHNICAL FIELD

The present invention relates to an active matrix type display device and a driving method thereof. In particular, the present invention relates to a method for the generation of sampling pulses and a source line driver circuit that generates sampling pulses.

BACKGROUND ART

One driving method of an active matrix type display device is a dot sequential system. In a driving method for the dot sequential system, source lines are selected sequentially during a period in which one row of the scanning line is selected, and video signal is written to pixels. More specifically, switches connected to each source line are turned on sequentially by a sampling pulse generated by a source line driver circuit that has a shift register, a buffer, and the like. The sampling pulse has two levels of electric potential: "High" and "Low".

A switch that makes a video line and the source line conduct is a switch that is turned on when the sampling pulse is "High" and is turned off when the sampling pulse is "Low". When the sampling pulse rises and comes to be at "High" level, the switch comes to be on, and the video signal is written to the source line. Then, when the sampling pulse falls and comes to be at "Low" level, the switch comes to be off, and the electric potential of the source line is fixed. In this way, the electric potential of each source line is fixed by switches that correspond to the plurality of source lines arranged in the pixels being turned on and off in order.

The length of a period during which the sampling pulse goes from "Low" to become "High" (the period during which writing starts, the rising period) and the length of a period during which the sampling pulse goes from "High" to become "Low" (the period during which writing finishes, the falling period) depend on the characteristics (typically, on current characteristics) of a transistor that forms the buffer of the source line driver circuit and the like, but if the transistor is a thin film transistor formed of polycrystalline silicon, the length of each of these periods comes to be about 10 ns to 50 ns During the period in which the electric potential of the source line is determined, if the electric potential of the source line is changed by the effects of noise or the like, this becomes a cause of display defects such as crosstalk (ghosting) or the like. In particular, when the structure of a display device is one in which one video signal is divided up and the divided up video signals are input to the source lines via a plurality of video signal lines, because the video signals are written to a plurality of source lines simultaneously, display defects can be seen periodically and become even more prominent.

What can be considered to be one cause of the noise generated in a source line is, as shown in FIG. 20, overlapping of the rising period of the sampling pulse that selects the source line of the subsequent step. FIG. 20 is a timing chart of input signals and output signals of a conventional source line driver circuit. CK is a clock signal, SP is a start pulse, and VIDEO is a video signal input to the video signal line. The numbers 1, 2, and 3 of the video signal (VIDEO) indicate the signals that are to be written to the source lines X_1, X_2, and X_3. Reference symbols (sam_1), (sam_2), and (sam_3) are sampling pulses for sampling of three adjacent source lines, and T indicates the period during which the video signal is written to the source line. As indicated by a dotted line 80 in FIG. 20, due to overlapping of the rising period of the sampling pulse (sam_2) and the rising period of the sampling pulse (sam_3), noise is generated in the source line.

For this reason, by the sampling pulses in adjacent sampling pulses being set so that they do not overlap in terms of time, the amount of noise is reduced (Refer to Patent Document 1 and Patent Document 2). Furthermore, as shown in FIG. 21, a method is used in which the width of the sampling pulse is made shorter than a half-cycle of the clock signal by a pulse width controller (PWC) or the like. By this method, the writing period T is made to be shorter than the writing period T shown in FIG. 20.

Patent Document 1: Japanese Published Patent Application No. 2001-265289

Patent Document 2: Japanese Published Patent Application No. 2003-337320

DISCLOSURE OF INVENTION

For the timing of the sampling pulse or the video signal, there is a need to consider fluctuations in the delay time of the sampling pulse due to characteristics (typically, on current characteristics) of a transistor forming the source line driver circuit or the time it takes for the electric potential of the source line to reach a certain level from when the video signals are written. For a method used to improve display quality, methods such as a method where the resolution is increased by the number of pixels being increased, a method like with double-speed frame driving where the frame frequency is increased, and the like are given; however, the frequency of writing to the source lines increases if any one of these methods is used. In order that, as shown in FIG. 21, the falling period of the sampling pulse not overlap with the rising period of the sampling pulse of the subsequent step, the pulse width of the sampling pulse needs to be decreased, but there is a problem that occurs with this in that the writing time for writing of the video signal to the source line is not long enough.

Furthermore, a field sequential driving method is one means of making the display high definition; however, for display of images by a field sequential system, as well, when the pulse width of the sampling pulse is decreased as shown in FIG. 21, there is a concern that the length of the writing time for writing to the source line will not be long enough. This is because, in the field sequential system, color images are displayed by display where R, G, and B images in one pixel are switched between each other temporally, so the length of time for writing of the video signals comes to be shorter in the field sequential system compared to the time for writing in a general color display method (a method in which a unit pixel is made up of three pixels, one of each of an R, a G, and a B pixel, where light from the three pixels is spatially blended).

In addition, when the pulse width of the sampling pulse is decreased, not only is the length of time for writing to the source line not long enough, but just generating the sampling pulse becomes difficult. In particular, when a thin film transistor formed of a non-single-crystal semiconductor is used for a transistor in the source line driver circuit, this problem becomes obvious.

In consideration of the aforementioned problems associated with the improvement of display quality, it is an object of the present invention to provide a source line driver circuit by which the length of time for writing to the source line is secured and which is well-suited for making the display device be high definition. Furthermore, it is an object of the present invention to provide a display device driving method by which the number of display defects caused by overlapping of adjacent sampling pulses is reduced.

First, a writing starting period and a writing finishing period of a sampling pulse will be described using FIG. 19. In the present invention, the sampling pulse includes both a pulse whose pulse width (writing period T) is determined by the electric potential during the "High" level period, as with pulse (A), and a pulse whose pulse width (writing period T) is determined by the electric potential during the "Low" level period, as with pulse (B). For pulse (A), the writing starting period $T_s$ is the period during which the electric potential goes from "Low" to "High", that is, the rising period, and the writing finishing period $T_f$ is the period during which the electric potential goes from "High" to "Low", that is, the falling period. For pulse (B), the writing starting period $T_s$ is the period during which the electric potential goes from "High" to "Low", that is, the falling period, and the writing finishing period $T_f$ is the period during which the electric potential goes from "Low" to "High", that is, the rising period.

The present invention is a source line driver circuit for an active matrix type display device that has a plurality of scanning lines, a plurality of source lines that intersect with the scanning lines, and a pixel portion that has a plurality of pixels that are connected to the source lines and the scanning lines. The source line driver circuit has a circuit for the generation of a plurality of sampling pulses, at least one video signal line to which video signals are input, and a plurality of switches that are connected to the source lines and that make the source lines conduct with the video signal line in accordance with the sampling pulse.

In order to resolve the insufficiency in the length of the writing time for writing to the source line, the source line driver circuit of the present invention generates adjacent sampling pulses that overlap with each other so that the writing finishing period of one sampling pulse ends after the writing starting period of the sampling pulse of the subsequent step begins.

Specifically, the source line driver circuit of the present invention generates a sampling pulse where the writing period of the sampling pulse begins before the video signal is switched to the video signal that is to be written by the sampling pulse and ends before the video signal is switched to the video signal that is to be written by the sampling pulse of the subsequent step.

Another source line driver circuit of the present invention generates a sampling pulse where the writing period of the sampling pulse begins before a video signal that is to be written by the sampling pulse of the first step is input to the video signal line and ends before the video signal is switched to the video signal that is to be written by the sampling pulse of the subsequent step.

Another source line driver circuit of the present invention generates a sampling pulse where the writing period of the sampling pulse begins during a period in which the video signal is switched to a video signal that is to be written by the sampling pulse of the previous step and ends before the video signal is switched to the video signal that is to be written by the sampling pulse of the subsequent step.

In addition, the present invention relates to a driving method of an active matrix type display device that has a plurality of scanning lines, a plurality of source lines that intersect with the scanning lines, a pixel portion that has a plurality of pixels that are connected to the source lines and the scanning lines, and at least one video signal line to which video signals are input.

The driving method for an active matrix type display device related to the present invention is a driving method that has generation of a plurality of sampling pulses based on start pulse signals and clock signals, writing of a video signal that is input to the video signal line to a source line based on the sampling pulse, retention of an electric potential of the source line to which the video signal is written, input of the video signal to a pixel that is connected to a selected scanning line via the source line, and confirmation of the video signal to be displayed by the pixel.

In order to resolve the display defects caused by noise generated in the source line described above, the driving method of the present invention is a method in which a plurality of sampling pulses are generated so that the writing finishing period of one sampling pulse ends after the writing starting period of the sampling period of the subsequent step begins. Furthermore, the pixel portion is placed in a non-display state during the period in which video signals are input to a pixel, and after video signals of all of the pixels are determined, the pixel portion is switched from a non-display state to a display state. In addition, the writing period of the sampling pulse begins before the video signal input to the video signal line switches to the video signal that is to be written by the sampling pulse and ends before the video signal input to the video signal line switches to the video signal that is to be written by the sampling pulse of the subsequent step.

Moreover, another driving method of the present invention is a method in which a plurality of sampling pulses are generated so that the writing period of one sampling pulse begins before the video signal that is to be written by the sampling pulse of the first step is input to the video signal line and ends before the video signal input to the video signal line switches to the video signal that is to be written by the sampling pulse of the subsequent step.

Furthermore, another driving method of the present invention is a method in which a plurality of sampling pulses are generated so that the writing period of one sampling pulse begins during a period in which the video signal that is to be written by the sampling pulse of the previous step is input to the video signal line and ends before the video signal input to the video signal line switches to the video signal that is to be written by the sampling pulse of the subsequent step.

By generation by the source line driver circuit of the present invention of adjacent sampling pulses that overlap, nearly all of a period during which the video signal that is to be written is input can be used for writing to the source line. In this way, because the maximum amount of time can be used for writing to the source line, the video signal line can be written to the source line most definitely.

In addition, if the source line driver circuit and driving method of the present invention are employed, there is no need to generate a sampling pulse shorter than half the period of the clock. The source line driver circuit of the present invention is one by which sampling pulses corresponding to the frequency of the clock signal can be generated, even without any decrease in display quality or use of a transistor that operates at high speed. In this way, the source line driver circuit and driving method of the present invention are extremely well-suited for making a display device be high definition.

Furthermore, by generation of sampling pulses by the source line driver circuit of the present invention, because the writing finishing period of one sampling pulse does not overlap with the writing starting period of the subsequent step, generation of noise in the source line can be avoided.

Moreover, the driving method of an active matrix type display device related to the present invention is one in which display defects such as crosstalk (ghosting) and the like do not occur because, even if a video signal corresponding to a source line of a different step is written to the source line of the current step during the writing period of a sampling pulse, the display period does not begin until after the video signal for all pixels is determined.

BEST MODE FOR CARRYING OUT THE INVENTION

Hereinafter, a method for generating a sampling pulse of the present invention will be described. In the present invention, as shown in FIG. 1 and FIG. 6, by generation of adjacent sampling pulses that overlap so that the writing finishing period of one sampling pulse ends after the writing starting period of the sampling pulse of the subsequent step begins, the writing period of the sampling pulses is lengthened.

Figure 1:
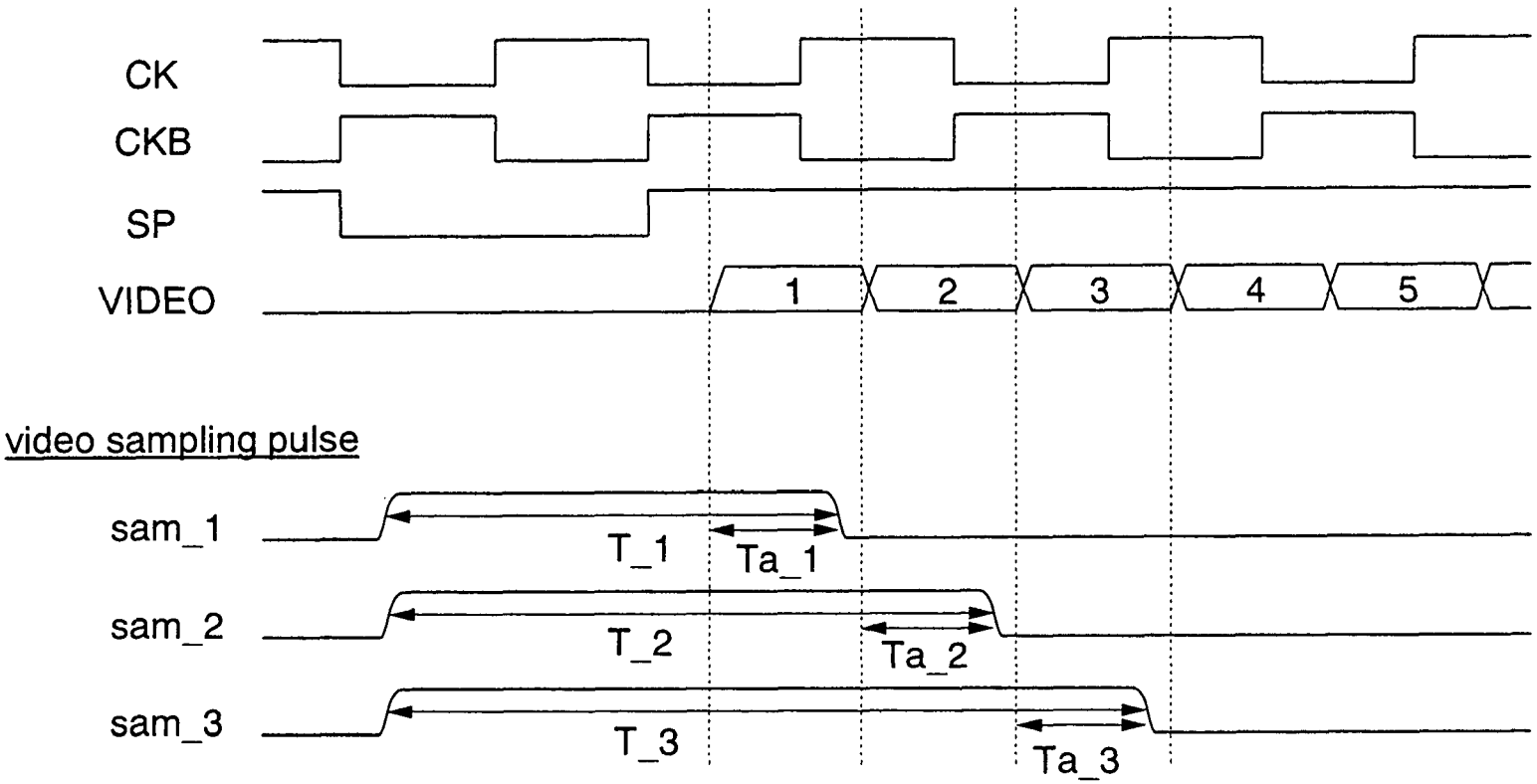
FIG. 1 is a timing chart for input signals and output signals of a source line driver circuit of Embodiment 1.
Figure 6:
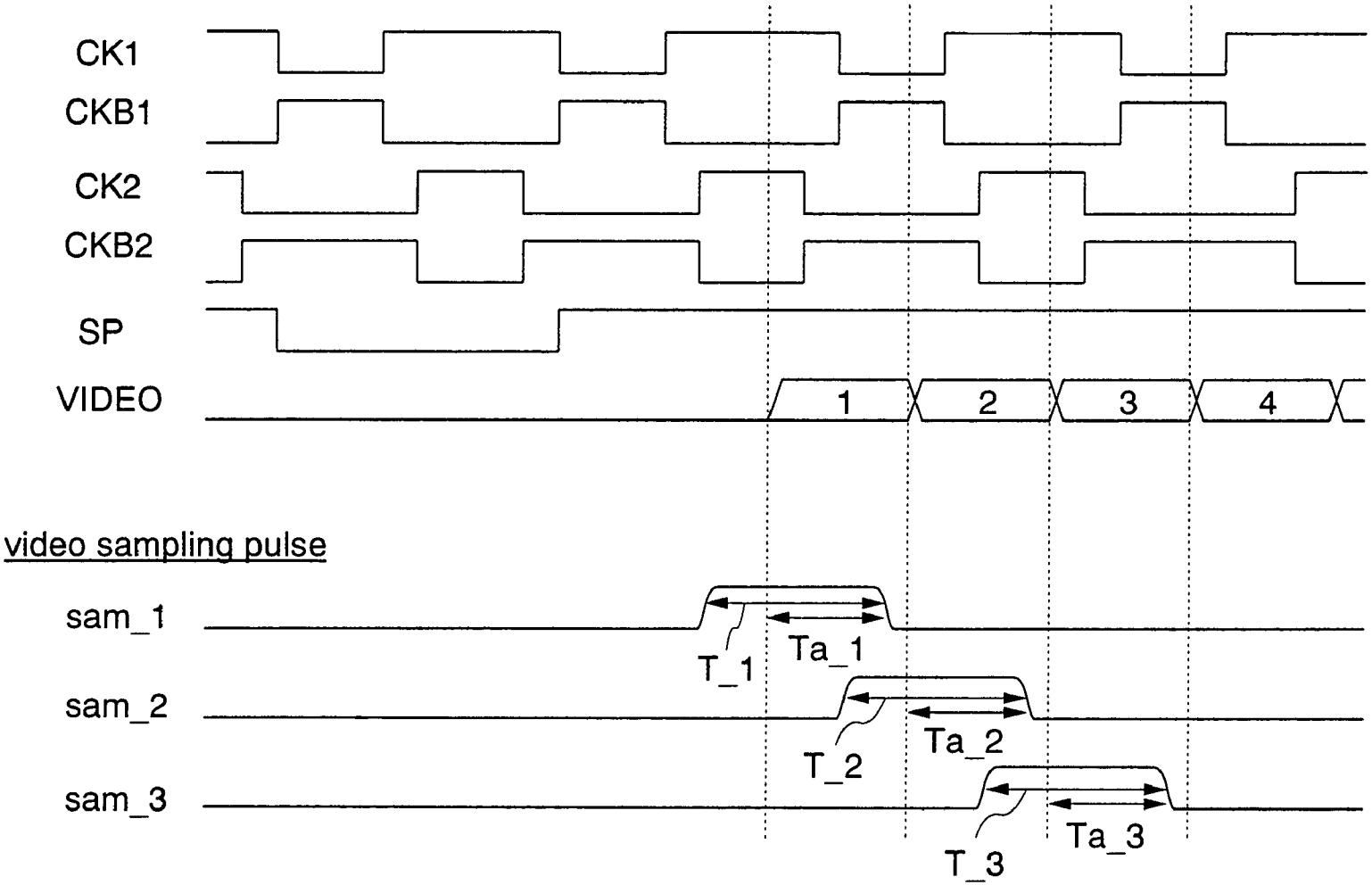
FIG. 6 is a timing chart for input signals and output signals of a source line driver circuit of Embodiment 2.
Figure 20:
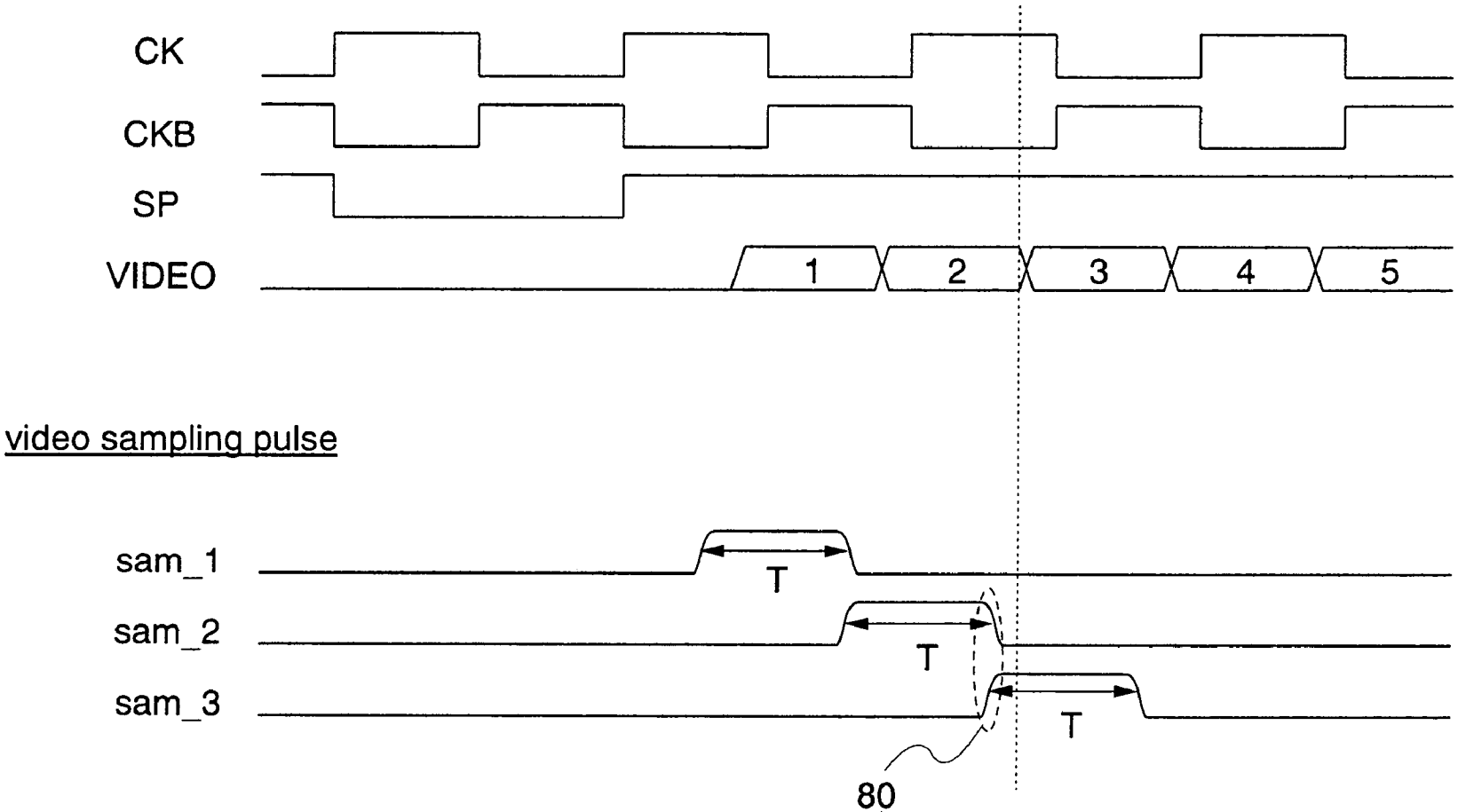
FIG. 20 is a timing chart for input signals and output signals of an example of a conventional source line driver circuit.
Figure 21:
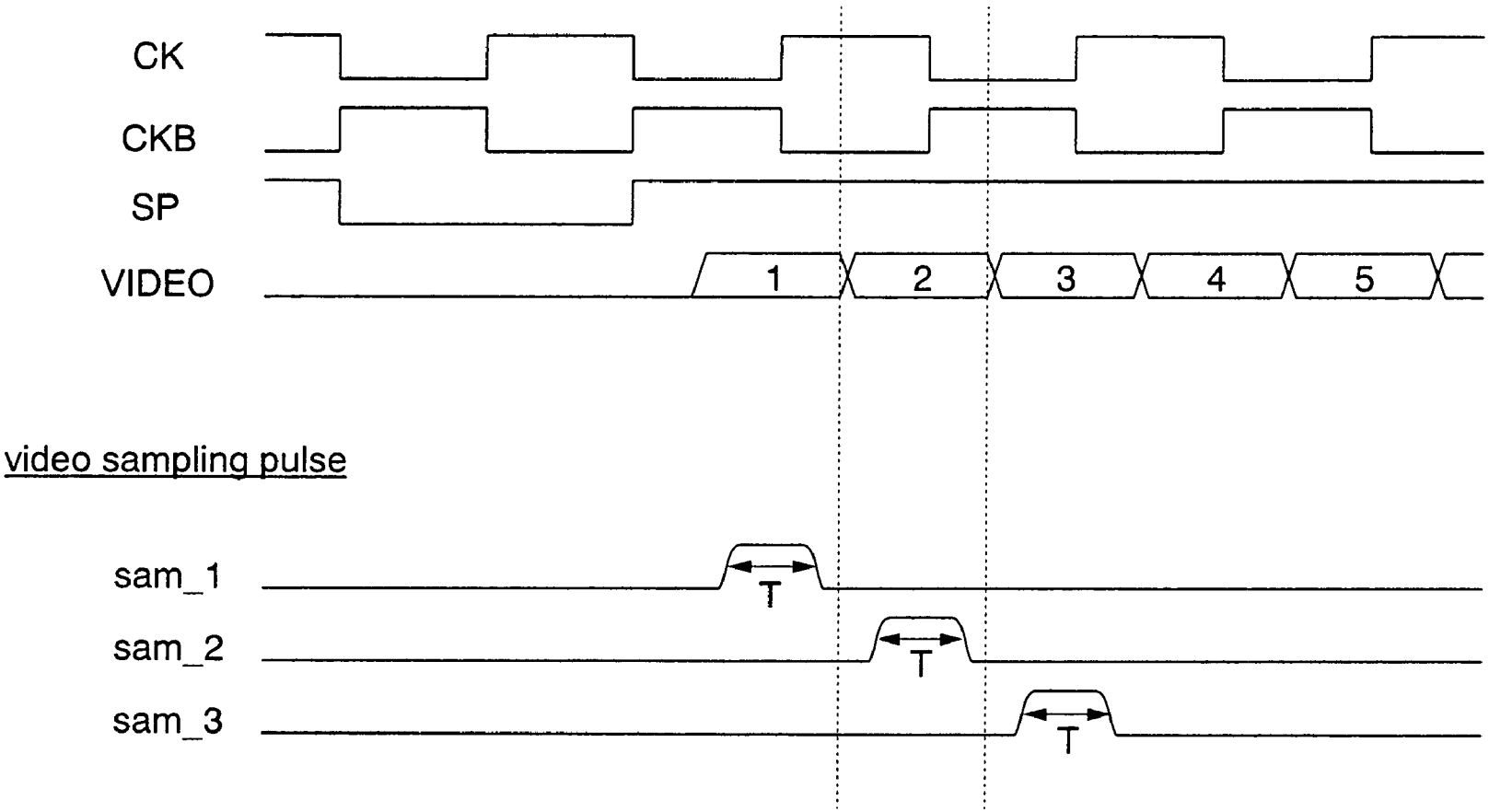
FIG. 21 is a timing chart for input signals and output signals of an example of a conventional source line driver circuit.

FIG. 1 and FIG. 6 are timing charts for input signals and output signals of the source line driver circuit of the present invention. Details of the source line driver circuit will be described in the embodiments. Because reference symbols such as "CK" and the like in FIG. 1 and FIG. 6 are used in common with those in FIG. 20 and FIG. 21, descriptions of FIG. 20 and FIG. 21 will be incorporated here.

The present invention will be explained with attention given to a second sampling pulse (sam_2) in FIG. 1 and FIG. 6. A writing period T_2 of the second sampling pulse (sam_2) ends after a writing period T_3 of the sampling pulse (sam_3) of the subsequent step begins. With the writing periods being set in this way, the adjacent sampling pulse (sam_2) and sampling pulse (sam_3) overlap.

Furthermore, the writing period T_2 of the sampling pulse (sam_2) begins before a video signal (VIDEO) switches from a video signal (VIDEO_1) to a video signal (VIDEO_2) and ends before the video signal (VIDEO) switches from the video signal (VIDEO_2) to a video signal (VIDEO_3).

In this way, by the sampling pulse (sam_2) being overlapped with the adjacent sampling pulse (sam_1) and the adjacent sampling pulse (sam_3), the video signal (VIDEO_2) can be written to the source line by the sampling pulse (sam_2) during nearly the entire period in which the video signal (VIDEO_2) that is to be written is input to the video signal line. That is, by the present invention, the length of the writing period for writing to the source line can be maximized.

In FIG. 1, an example is shown in which the writing periods T of all sampling pulses (sam_1, sam_2, sam_3, . . . ) are set so that they all begin before the period during which the video signal (VIDEO_1) that is to be written by the sampling pulse (sam_1) of the first step is input to the video signal line.

In FIG. 6, an example is shown in which the writing period T_2 of the sampling pulses (sam_2) is set so that it begins before the period during which the video signal (VIDEO_1) that is to be written by the sampling pulse (sam_1) of the previous step is input to the video signal line.

By generation of the sampling pulses by the method of the present invention, before the electric potential of the source line is determined, the video signal (VIDEO_1) that is to be written to a different source line by the sampling pulse (sam_1) of the previous step is written to the source line by the sampling pulse (sam_2). Consequently, when the sampling pulses are generated by the method of the present invention, for driving of an active matrix type display device, during the period in which video signals are input to the pixel portion, the pixel portion is placed in a non-display state, and after the video signals of all pixels are determined, the pixel portion is switched from being in a non-display state to being in a display state. Thus, even if there is a period of time during the writing period T in which a video signal that is not to be written to the source line is written thereto by the sampling pulse (sam), the display is not negatively affected.

Hereinafter, in each embodiment, specific structures of source line driver circuits for increasing the pulse width and lengthening the writing period of sampling pulses and driving methods of an active matrix type display device will be described with reference to drawings.

However, the present invention can be implemented in many different embodiments, and it is easily understood by a person skilled in the art that the form and details can be changed in a variety of ways without any departure from the spirit and scope of the present invention. Hence, the present invention is not to be interpreted as being limited to the content of the embodiments described herein. It is to be noted that reference symbols used in common in different figures are used to represent the same components, and repetitive description thereof shall be omitted.

Embodiment 1

First, using drawings, a structure of an active matrix type display device of the present invention will be described.

Figure 15:
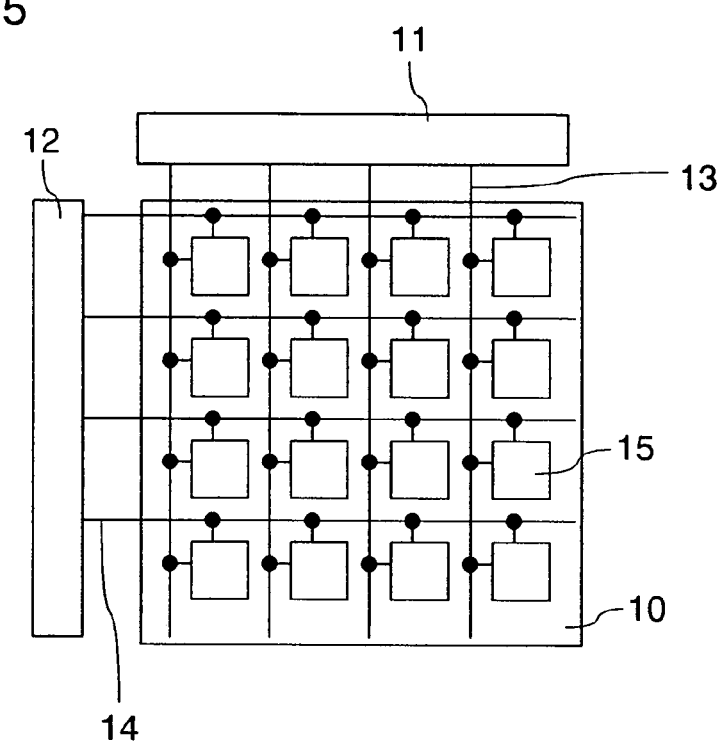
FIG. 15 is a block diagram illustrating an example of a structure of an active matrix type display device of the present invention.

FIG. 15 is a block diagram of an example of a structure of the active matrix type display device of the present invention. The active matrix type display device of the present invention has a pixel portion 10, a source line driver circuit 11, a scanning line driver circuit 12, a plurality of source lines 13 that are connected to the source line driver circuit 11, and a plurality of scanning lines 14 that are connected to the scanning line driver circuit 12. The structure of the active matrix type display device is the same as that of other embodiments.

The plurality of source lines 13 are arranged in columns, and the plurality of scanning lines 14 are arranged in rows in intersection therewith. In the pixel portion 10, a plurality of pixels 15 are arranged in a row-column fashion corresponding to the rows and columns made by the source lines 13 and the scanning lines 14. A pixel 15 is connected to a source line 13 and a scanning line 14. The pixel 15 has a switching element and a display element. The switching element controls whether a pixel is selected or not, based on signals input to the scanning line 14. The display element controls gradation based on signals input from the source line 13.

Figure 16:
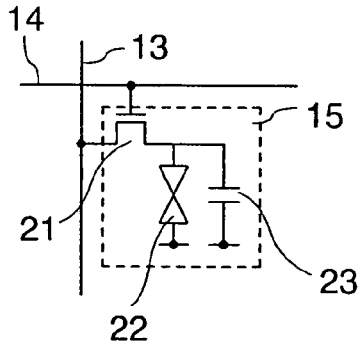
FIG. 16 is a circuit diagram illustrating an example of a structure of a pixel when the present invention is applied to an active matrix liquid crystal display device.

Using FIG. 16 and FIG. 17, an example of the structure of the pixel 15 will be described. An example of the structure of the pixel 15 when the present invention is applied to an active matrix liquid crystal display device is shown in FIG. 16. The pixel 15 has a switching transistor 21 for the switching element and a liquid crystal element 22 for the display element. A gate of the switching transistor 21 is connected to the scanning line 14, and either one of a source or drain of the switching transistor 21 is connected to the source line 13 while the other is connected to the liquid crystal element 22.

The liquid crystal element 22 has a pixel electrode, a counter electrode, and a liquid crystal. The orientation of the liquid crystal is controlled by the electric field produced by the pixel electrode and the counter electrode. The liquid crystal is injected between two substrates in the active matrix liquid crystal display device. A capacitor 23 is an element used to retain the electric potential of the pixel electrode of the liquid crystal element 22 and is connected to the pixel electrode of the liquid crystal element 22.

Figure 17:
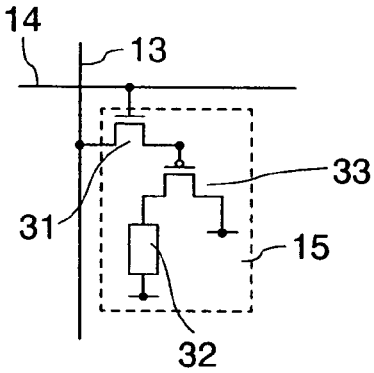
FIG. 17 is a circuit diagram illustrating an example of a pixel when the present invention is applied to an active matrix electroluminescent display device.

An example of the structure of the pixel 15 when the present invention is applied to an active matrix electroluminescent display device is shown in FIG. 17. The pixel 15 has a switching transistor 31 for the switching element and a light-emitting element 32 for the display element. Furthermore, the pixel 15 has a driving transistor 33 that is connected to a gate of the switching transistor 31. The light-emitting element 32 has a pair of electrodes and a luminescent material interposed between the pair of electrodes.

Figure 2:
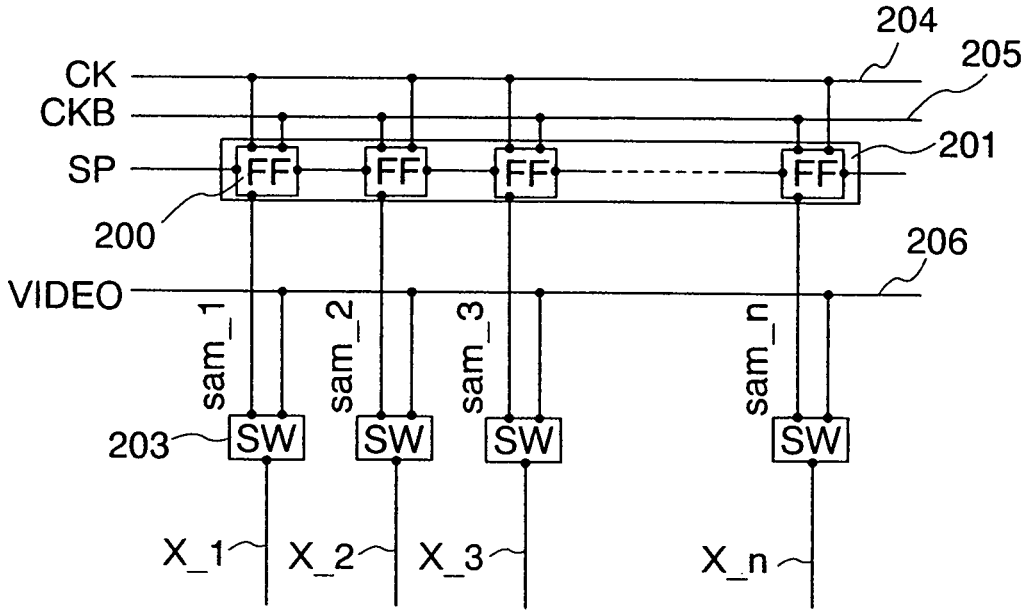
FIG. 2 is a block diagram of the source line driver circuit of Embodiment 1.

Below, using FIG. 2, a specific structure of the source line driver circuit of the present invention will be described. FIG. 2 is a block diagram of the source line driver circuit of the present embodiment. In FIG. 2, a source line driver circuit in which the number of source lines is n is shown. The first, second, third, . . . , and n-th source lines are represented by X_1, X_2, X_3, . . . , and X_n. In the present specification and drawings, by attachment of _1, _2, _3, . . . , and _n to the symbols for wirings, circuits, signals, and the like, the first, second, third, . . . , and n-th ones are set to be represented, in order.

The source line driver circuit has a shift register 201 to which flip-flops (FF) 200 for a plurality of steps are connected, an n number of switches (SW) 203, a clock signal line 204 to which clock signals (CK) are input, an inverted clock signal line 205 to which inverted clock signals (CKB) are input, and a video signal line 206 to which video signals (VIDEO) are input. The clock signal (CKB) is an inverted clock signal, which is the inversion of the clock signal (CK).

In the present embodiment, the shift register 201 has flip-flops (FF) 200 for n (where n is an integer greater than or equal to 2) number of steps. The flip-flop 200 for each step is connected to the clock signal line 204 and the inverted clock signal line 205 so that the input switches back and forth between the clock signal (CK) and the inverted clock signal (CKB) alternatingly.

The switch 203 is a circuit used to make each source line X_1, X_2, X_3, . . . , and X_n conduct with the video signal line 206, and one is provided for each source line. Each of the n number of flip-flops 200 generates and outputs a sampling pulse (sam). Each sampling pulse (sam) is input to one of the switches 203. The on and off for the switch 203 is controlled in accordance with the sampling pulse (sam). When the switch 203 comes to be in the on state, the source line and the video signal line 206 conduct, and the video signal (VIDEO) is input to the source line.

Figure 3:
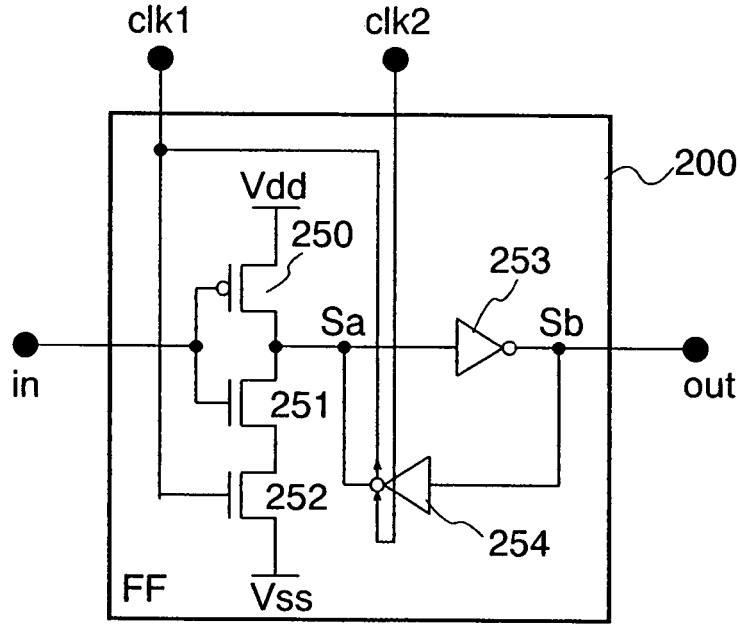
FIG. 3 is a circuit diagram of a flip-flop in FIG. 2.

FIG. 3 is a circuit diagram of the flip-flop 200. Reference symbol "in" refers to an input of the flip-flop 200, and reference symbol "out" refers to an output of the flip-flop 200. The output "out" of one flip-flop 200 is input to the input "in" of the flip-flop 200 of the subsequent step, and a start pulse (SP) is connected to the input "in" of the flip-flop 200 of the first step. Reference symbols "clk1" and "clk2" refer to clock inputs. One of the clock inputs "clk1" and "clk2" is connected to the clock signal line 204, and the other one is connected to the inverted clock signal line 205. In the example of a structure of the shift register 201 in FIG. 2, the clock input "clk1" of an odd-numbered step is connected to the clock signal line 204, and the clock input "clk2" of an even-numbered step is connected to the inverted clock signal line 205.

The flip-flop 200 has a p-type transistor 250, a first n-type transistor 251 and a second n-type transistor 252, an inverter 253, and a clocked inverter 254, all connected in series.

A source of the p-type transistor 250 is connected to a high-voltage power supply potential $V_{dd}$, and a source of the second n-type transistor 252 is connected to a low-voltage power supply potential $V_{ss}$. A gate of the p-type transistor 250 and a gate of the first n-type transistor 251 are connected to the input "in" of the flip-flop 200, and a gate of the second n-type transistor 252 is connected to the clock input "clk1". That is, a circuit formed of these three transistors 250 to 252 corresponds to a circuit of a clocked inverter formed of two p-type transistors and two n-type transistors from which a p-type transistor that is connected to $V_{dd}$ and that controls the clock signals is removed.

An input of the inverter 253 is connected to a drain of the p-type transistor 250 and a drain of the first n-type transistor 251, and an output thereof is connected to the output out of the flip-flop 200. An input of the clocked inverter 254 is connected to the output of the inverter 253, and an output thereof is connected to the input of the inverter 253 as well as to the drain of the p-type transistor 250 and the drain of the first n-type transistor 251.

The clocked inverter 254 is a means used to retain an electric potential of a node $S_a$. The clocked inverter 254 is connected to the clock inputs "clk1" and "clk2" and functions as an inverter synchronized with clock signals input from the clock input "clk2". It is to be noted that in exchange for the clocked inverter 254, a storage capacitor can be connected to the node $S_a$ and set so that it retains the electric potential of the node $S_a$.

In the source line driver circuit shown in FIG. 2, the sampling pulse (sam) is output from the node $S_a$ or a node $S_b$. The output of the node $S_b$ has an inverted relationship with the output of the node $S_a$.

FIG. 1 is a timing chart of the input signals and output signals of the source line driver circuit shown in FIG. 2. It is to be noted that FIG. 1 is a timing chart for when the sampling pulse (sam) is output from the node $S_a$ of the flip-flop 200, and the switch 203 makes the source line and the video signal 206 conduct between each other when the sampling pulse (sam) is at a "High" level and not conduct between each other when the sampling pulse (sam) is at a "Low" level.

When the start pulse (SP) goes from "High" to "Low", the p-type transistor 250 of the flip-flop 200_1 of the first step comes to be on while the start pulse (SP) is "Low", and a signal of "Low" level is transmitted to the input (in) of the flip-flop 200 of each step. Furthermore, when the node $S_a$ of the flip-flop 200 of each step goes from "Low" to "High", the sampling pulses (sam_1, sam_2, sam_3, . . . , and sam_n) are generated and output. That is, the writing starting period $T_s$ of the sampling pulses (sam_1, sam_2, sam_3, . . . , and sam_n) is synchronized with the start pulse (SP).

That is, the sampling pulse (sam) is generated so that the writing period T of the sampling pulse (sam) is set to start before the video signal switches to the video signal that is to be written. In the example of FIG. 1, the writing period T of each sampling pulse starts before the video signal switches to the video signal (VIDEO_1).

When the start pulse (SP) goes from "Low" to "High", the electric potential of the node $S_a$ of the flip-flop 200_1 of the first step is retained as "High" during half of the period of the clock signal (CK). When the clock signal (CK) rises, the electric potential of the node $S_a$ of the flip-flop 200_1 of the first step comes to be "Low", and the electric potential of the node $S_b$ comes to be "High".

Accordingly, for the flip-flops 200 of the second step and steps after the second step, delayed by half the period of the clock signals (CK, CKB), the electric potential of the node $S_a$ goes from "High" to "Low", in sequence, and the electric potential of the node $S_b$ goes from "Low" to "High", in sequence.

Thus, as shown in FIG. 1, the writing periods T_1, T_2, T_3, . . . , and T_n of the sampling pulses (sam_1, sam_2, sam_3, . . . , and sam_n) each come to finish a half of a period of the clock signals (CK, CKB) lagging behind each other. As a result, by the source line driver circuit in FIG. 2, the writing period T (pulse width) of the sampling pulse (sam) comes to be longer than one period of the clock signals (CK, CKB).

The video signal (VIDEO) is input to the video signal line 206 according to how the source lines are arranged. The numbers 1, 2, and 3 for the video signal (VIDEO) in FIG. 1 indicate to which of the source lines X_1, X_2, X_3, . . . , and X_n the signal should be written. The starting period and finishing period of the sampling pulse (sam) lag behind the clock signals (CK, CKB) due to an internal delay and the like of the flip-flop 200. The video signal (VIDEO) is input to the video signal line 206 with the delay of the sampling pulse (sam) taken into account.

When each of the sampling pulses (sam_1, sam_2, sam_3, . . . and sam_n) is input to its respective one of the switches 203_1, 203_2, 203_3, . . . , and 203_n, the switches 203_1, 203_2, 203_3, . . . and 203_n each come to be on, and writing of the video signal (VIDEO) to the source lines X_1, X_2, X_3, . . . , and X_n starts.

Because the writing period (T_1, T_2, T_3, . . . , and T_n) of each of the sampling pulses (sam_1, sam_2, sam_3, . . . , and sam_n) finishes delayed behind each other by half the period of the clock signals (CK, CKB), each of the switches 203_1, 203_2, 203_, . . . , and 203_n are turned off in sequence, each lagging behind the previous one by half the period of the clock signals (CK, CKB), and the electric potential of each of the source lines X_1, X_2, X_3, . . . , and X_n is determined. The video signal (VIDEO) is written to a pixel that is connected to the scanning line that is selected during this period via the source lines X_1, X_2, X_3, . . . , and X_n.

For example, by the sampling pulse (sam_2), when writing to the source line X_2 starts, first, the video signal (VIDEO_1) is written, then the video signal (VIDEO_2) is written during the period T_2, and the electric potential of the source line X_2 is determined as the electric potential of the video signal line (VIDEO_2). That is, the period $T_a$ refers to the writing period during which the video signal (VIDEO) that is to be written is written to the source line by the sampling pulse (sam).

The minimum length of the period of switching of the video signal (VIDEO) comes to be half the period of the clock signals (CK, CKB). The writing finishing period $T_f$ of the sampling pulse (sam) is set to be right before switching of the video signal (VIDEO), whereby the length of the writing period $T_a$_2 of the video signal (VIDEO_2) to the source line X_2 can be made to be approximately equal to the length of the period during which the video signal (VIDEO_2) is being input. In other words, the length of the period $T_a$_2 can be made to be approximately equal to half the period of the clock signals (CK, CKB). In this way, in the present embodiment, because the maximum amount of time, which is also half the period of the clock signals (CK, CKB), can be used for the writing of the video signal (VIDEO), the video signal (VIDEO) can be most definitely written to the source line.

Furthermore, because the width of the sampling pulse (the writing period T) is longer than one period of the clock signals (CK, CKB), for the source line driver circuit of the present invention, the range of frequencies of the video signal by which the sampling pulse can be generated is broad.

In addition, because the writing starting periods $T_s$ and the writing finishing periods $T_f$ of adjacent sampling pulses (sam) do not overlap, the generation of noise in the source lines can be eliminated.

It is to be noted that, as shown in the timing chart of FIG. 1, the length of the writing period T of the sampling pulse (sam) is longer than the length of the writing period $T_a$ for the video signal that is to be written, and the video signal that is to be written to the previous row is also written to the source line. For this reason, when a display device that has the source line driver circuit of FIG. 2 is made to work, in the writing period during which the video signal is written to a pixel in the pixel portion (hereinafter, also referred to as an "address storage period"), the pixel portion 10 is placed in a non-display state; after the address storage period ends, the pixel portion 10 is placed in a display state, and gradation is displayed by each pixel according to video signal data that is written.

Figures 18A, 18B:
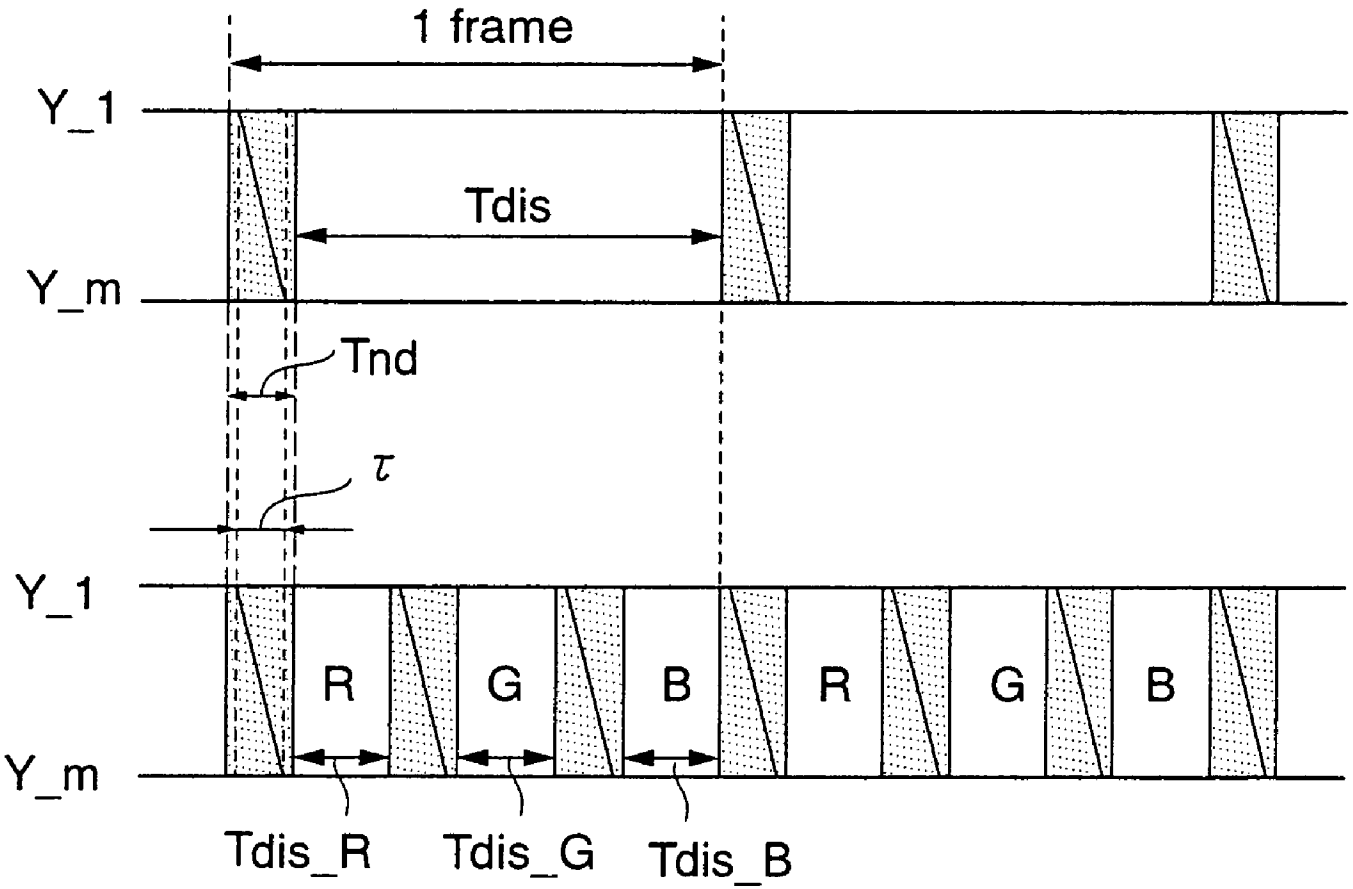
FIG. 18A is a diagram for describing a driving method of an active matrix type display device of the present invention.
FIG. 18B is a diagram for describing a driving method when the present invention is applied to a field-sequential system.
Figure 19:
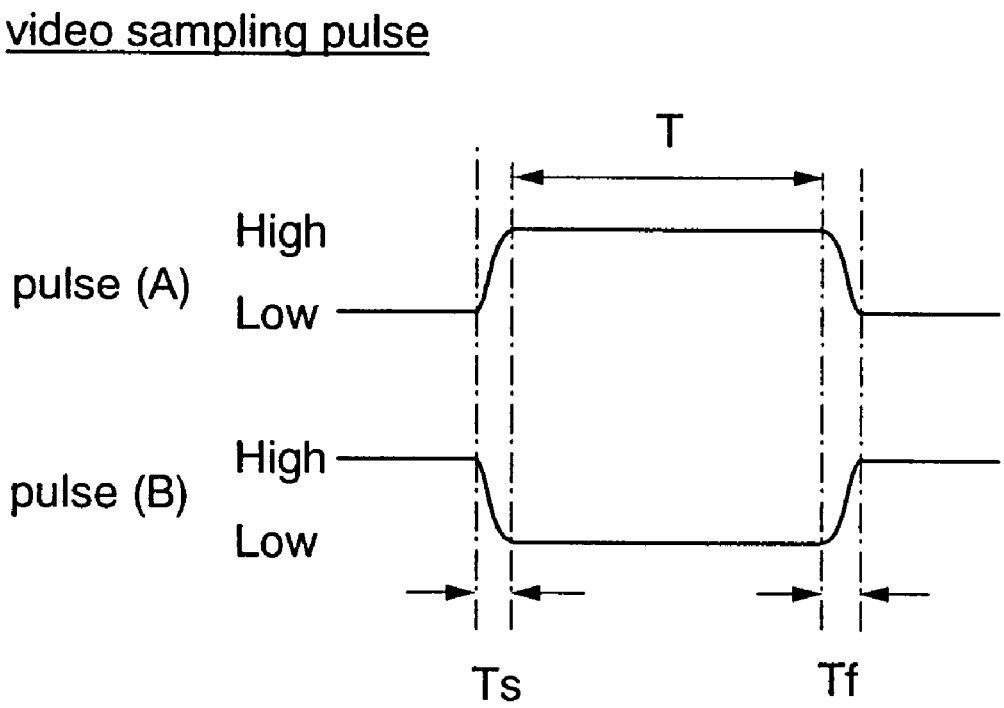
FIG. 19 is a diagram for describing a period during which writing starts, a period during which writing finishes, and a writing period of a sampling pulse of the present invention.

Using FIG. 18A, a driving method for an active matrix type display device of the present invention will be described. FIG. 18A is a diagram that shows the relationship between scanning of the scanning lines, the display period of the pixel portion 10, and the address storage period. As shown in FIG. 18A, the address storage period τ is included in the non-display period $T_{nd}$. During the non-display period $T_{nd}$, an m number of scanning lines from scanning line Y_1 to scanning line Y_m are selected sequentially, and the video signal (VIDEO) is written to the pixel 15 via the source lines X_1, X_2, X_3, . . . , and X_n. After the passage of the address storage period τ, the display period $T_{dis}$ starts.

FIG. 18B is a diagram that shows the relationship between scanning of the scanning lines, the display period of the pixel portion 10, and the address storage period for when display is performed by the field sequential system. During one frame period, the display period is divided into three periods: a display period $T_{dis}$_R during which red-colored images are displayed, a display period $T_{dis}$_G during which green-colored images are displayed, and a display period $T_{dis}$_B during which blue-colored images are displayed. During the non-display period $T_{nd}$ before each of the display periods $T_{dis}$_R, $T_{dis}$_G, and $T_{dis}$_B, data is stored in the pixel 15. In the field sequential system, the frequency of the video signal (VIDEO) increases; however, by use of the source line driver circuit of FIG. 2, following the frequency of the video signal (VIDEO), the sampling pulse (sam) can be generated, and the writing period $T_a$ for writing to the source line can be maintained, as well.

As in FIG. 18A and FIG. 18B, in order that, in one frame, the non-display period $T_{nd}$ and the display period $T_{dis}$ be set so as to be present, for a liquid crystal display device, a backlight may be set so as not to light up during the non-display period $T_{nd}$ and to light up during the display period $T_{dis}$. Furthermore, for an electroluminescent display device, a light-emitting pixel 32 (refer to FIG. 17) may be set so as not to light up during the non-display period $T_{nd}$ and to light up during the display period $T_{dis}$. Control of the state during which the light-emitting element 32 does not light up and the state during which it does light up can be performed, for example, by control of the voltages of both electrodes of the light-emitting pixel 32.

In the source line driver circuit of the present invention, during the address storage period τ, a video signal corresponding to a source line of a different step is written to the source line; however, as shown in FIGS. 18A and 18B, because the display period $T_{dis}$ starts after the electric potential of every source line is determined, there is no occurrence of display defects such as crosstalk (ghosting) or the like.

Figure 4:
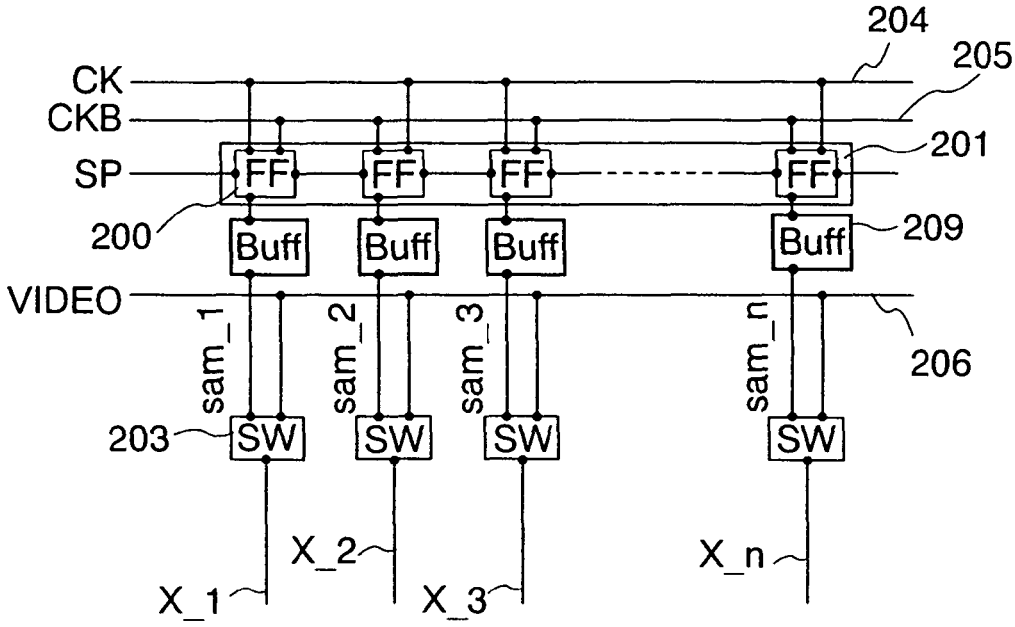
FIG. 4 is a block diagram of the source line driver circuit of Embodiment 1 that has a buffer.
Figure 5:
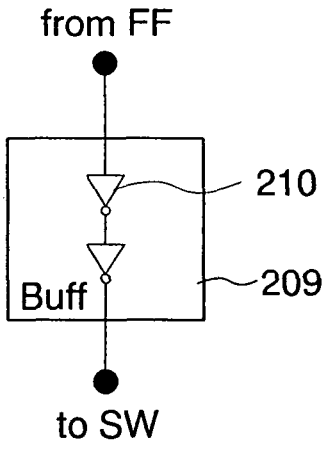
FIG. 5 is a circuit diagram of a buffer in FIG. 4.

In the source line driver circuit of FIG. 2, an output from the flip-flop 200 is connected to the switch 203; however, as shown in FIG. 4, an output of the flip-flop 200 can be connected to the buffer (Buff) 209 and the sampling pulse (sam) can be input to the switch 203 via the buffer 209, as well. An equivalent circuit of the buffer 209 for this case is shown in FIG. 5. For example, the buffer 209 can be formed of an even number of the inverters 210 connected in series. In FIG. 5, an example of a buffer 209 formed by two of the inverters 210 connected in series is shown.

For the timing chart of FIG. 1, an example in which the sampling pulse (sam) is output from the node $S_a$ of the flip-flop 200 was described, but the sampling pulse (sam) can be output from the node $S_b$ of the flip-flop 200, as well. For this case, in the source line driver circuit of FIG. 2 or FIG. 4, the source line driver circuit may have a structure in which the switch 203 is set to be on when the sampling pulse (sam) is "Low" and set to be off when the sampling pulse (sam) is "High". Alternatively, if a switch that is set to be on when the sampling pulse (sam) is "High" and set to be off when the sampling pulse (sam) is "Low" is used for the switch 203, as shown in FIG. 4, the source line driver circuit can be set so as to have a structure in which the buffer 209 is provided and the output from the node $S_b$ of the flip-flop 200 is inverted and input to the switch 203 by the buffer 209, as well. For this case, the buffer 209 may be formed of an odd number of inverters connected in series.

In this way, in the source line driver circuit of FIG. 2, the sampling pulse (sam) can be output from either the node $S_a$ or the node $S_b$ of the flip-flop 200, and the logic of the switch 203 and the buffer 209 can be determined according to the output of the flip-flop 200 or, alternatively, another logic circuit or other logic circuits may be added.

Embodiment 2

In the present embodiment, a source line driver circuit formed with a structure different from the structure of the source line driver circuit of Embodiment 1 will be described. In the present embodiment, the structure of a source line driver circuit in which a sampling pulse is generated, where the width of the pulse is longer than half the period of the clock signal and shorter than one full period of the clock signal, will be described.

Figure 7:
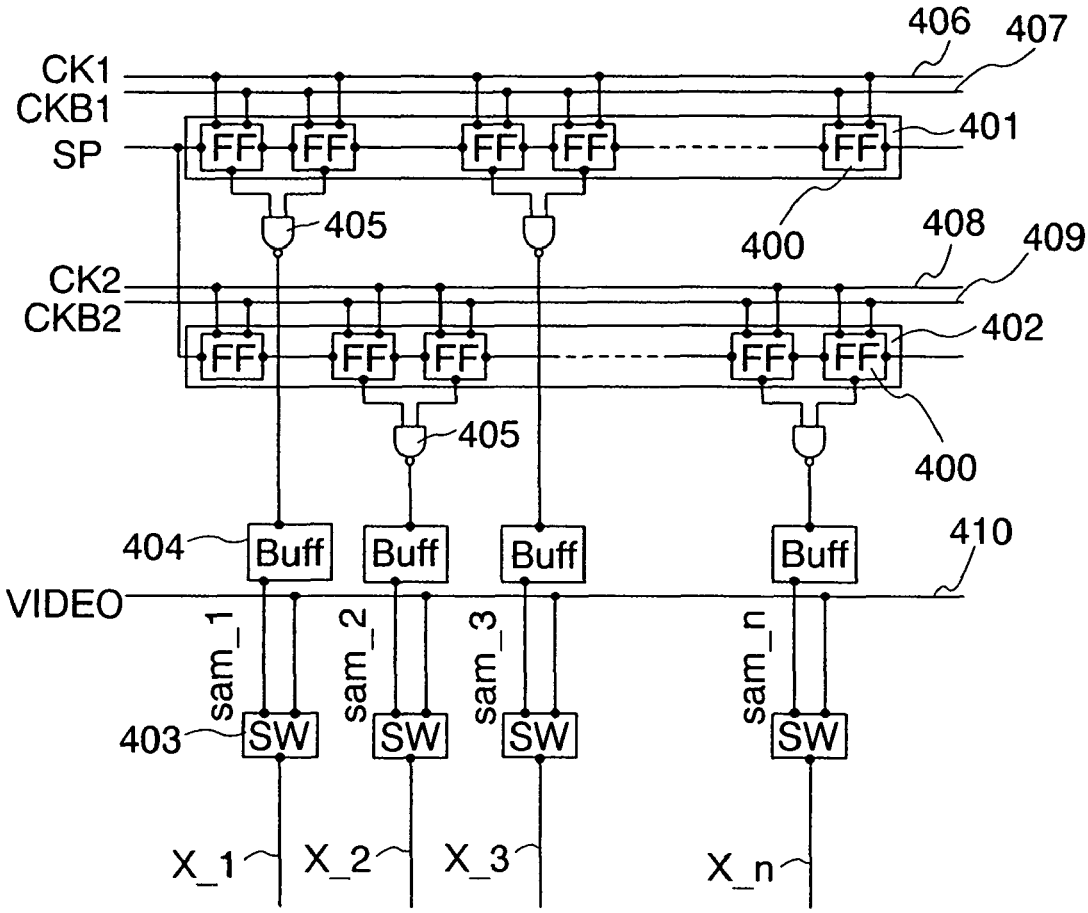
FIG. 7 is a block diagram of the source line driver circuit of Embodiment 2.

FIG. 7 is a block diagram of the source line driver circuit of the present embodiment. The source line driver circuit has two-phase shift registers 401 and 402, an n number of switches (SW) 403, an n number of buffers (Buff) 404 that are connected to the switches 403, and an n number of logic circuits 405 that perform logic operations on a pulse output from the shift register 401 or on a pulse output from the shift register 402. The source line driver circuit also has a clock signal line 406 to which a clock signal (CK1) is input, an inverted clock signal line 407 to which an inverted clock signal (CKB1) is input, a clock signal line 408 to which a clock signal (CK2) is input, an inverted clock signal line 409 to which an inverted clock signal (CKB2) is input, and a video signal line 410 to which a video signal (VIDEO) is input. The clock signal (CKB1) is an inverted clock signal that is the inversion of the clock signal (CK1), and the clock signal (CKB2) is an inverted clock signal that is the inversion of the clock signal (CK2).

The shift registers 401 and 402 each include a plurality of flip-flops 400. The flip-flops 400 of the shift registers 401 and 402 are circuits all formed with the same structure. In the shift register 401, the flip-flop 400 of each step is connected to the clock signal line 406 and the inverted clock signal line 407 so that input switches back and forth between the clock signal (CK1) and the inverted clock signal (CKB1). In the shift register 402, the flip-flop 400 of each step is connected to the clock signal line 408 and the inverted clock signal line 409 so that input switches back and forth between the clock signal (CK2) and the inverted clock signal (CKB2).

Each of the switches 403 is a circuit used to make a source line and the video line 410 conduct between each other, and one of the switches 403 is provided for each source line. The input of the sampling pulse in each of the switches 403 is connected to one of the buffers 404, and the on and off for each of the switches 403 is controlled in accordance with the sampling pulse (sam). When the switch 203 is placed in the on state, the source line and the video signal line 410 conduct between each other, and the video signal (VIDEO) is input to the source line. The start pulse (SP) is shared between the shift registers 401 and 402.

Figure 8:
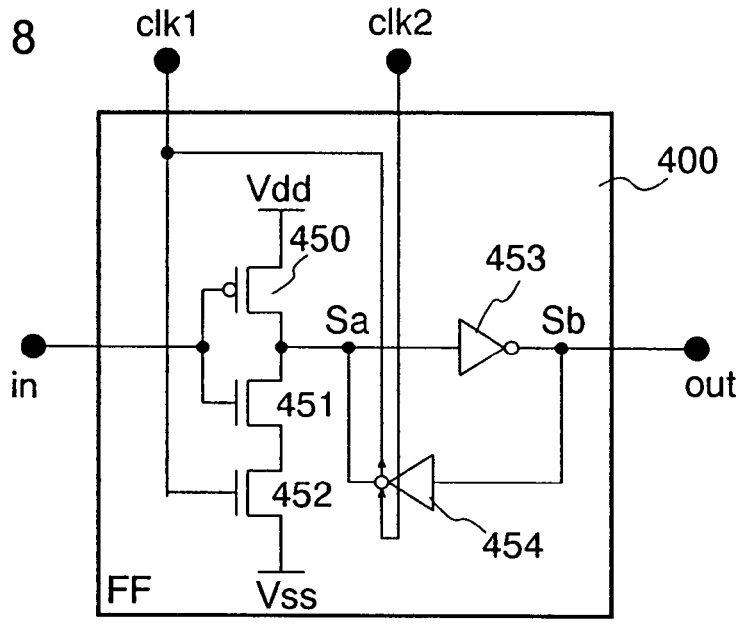
FIG. 8 is a circuit diagram of a flip-flop in FIG. 7.

FIG. 8 is a circuit schematic of the flip-flop 400. The flip-flop 400 is a circuit with the same structure as the flip-flop 200 in FIG. 3. In FIG. 8, reference numeral 450 refers to a p-type transistor, reference numeral 451 refers to a first n-type transistor, reference numeral 452 refers to a second n-type transistor, reference numeral 453 refers to an inverter, and reference numeral 454 refers to a clocked inverter. Of course, as with the flip-flop 200, a storage capacitor can be connected to the node $S_a$ and set so that the electric potential of the node $S_a$ is stored therein, as well, as a substitute for the clocked inverter 454. The output out for each of the shift registers 401 and 402 is connected to the input "in" of the flip-flop 400 of the subsequent step, and the start pulse (SP) is input to the input "in" of the flip-flop 400 of the first step.

In the shift register 401, the clock signal (CK1) is input to a clock input "clk1" of the flip-flop 400 of an odd-numbered step, and the clock signal (CKB1) is input to the clock input "clk1" of the flip-flop 400 of an even-numbered step. In the shift register 402, the clock signal (CK2) is input to a clock input "clk1" of the flip-flop 400 of an odd-numbered step, and the clock signal (CKB2) is input to the clock input "clk1" of the flip-flop 400 of an even-numbered step.

The output of each of the flip-flops 400 of the adjacent two steps is connected to the logic circuit 405. In the logic circuit 405, logic operations are performed on two pulses that are input. The pulse input to the logic circuit 405 is taken from either the node $S_a$ or the node $S_b$ of the flip-flop 400. The results of the logic operations of the logic circuit 405 are input to the switch 403 via the buffer 404 as the sampling pulse (sam).

In the shift register 401, from the first step, the flip-flops 400 of every two steps are connected to the same logic circuit 405, and in the shift register 402, from the second step, the flip-flops 400 of every two steps are connected to the same logic circuit 405. That is, the outputs of the flip-flops 400 of the $(2k-1)^{th}$ and $(2k)^{th}$ steps of the shift register 401 are connected to the logic circuit 405 of the $(2k-1)^{th}$ step, and the outputs of the flip-flops 400 of the $(2k)^{th}$ and $(2k+1)^{th}$ steps of the shift register 402 are connected to the logic circuit 405 of the $(2k)^{th}$ step.

Furthermore, the logic circuits 405 connected to the shift register 401 are connected to the switches 403 of odd-numbered steps, and the logic circuits 405 connected to the shift register 402 are connected to the switches 403 of even-numbered steps.

FIG. 6 is a timing chart of input signals and output signals of the source line driver circuit of FIG. 7. The timing chart of FIG. 6 is a timing chart of the source line driver circuit for when a NAND circuit is used for the logic circuit 405, a buffer that inverts and outputs a signal input to it is used for the buffer 404, and a switch that comes on when the sampling pulse (sam) is "High" is used for the switch 403. A circuit schematic of the buffer 404 in this case is shown in FIG. 9, and a circuit schematic of the switch 403 in this case is shown in FIG. 10.

Figure 9:
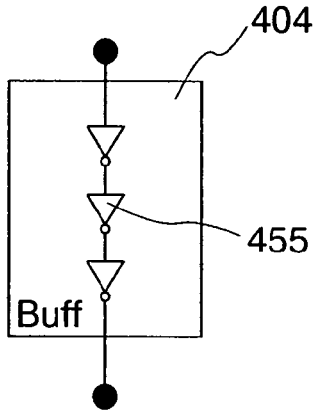
FIG. 9 is a circuit diagram of a buffer in FIG. 7.
Figure 10:
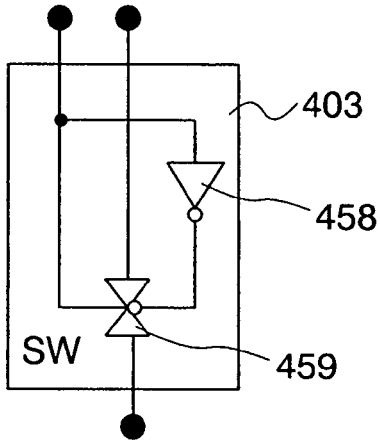
FIG. 10 is a circuit diagram of a switch in FIG. 7.

As shown in FIG. 9, the buffer 404 is formed of an odd number of inverters 455 connected in series. In FIG. 9, an example is shown in which the inverters 455 for three steps are connected in series. As shown in FIG. 10, the switch 403 is formed of an inverter 458 and an analog switch 459.

Operations of the shift registers 401 and 402 are the same as the operations of the shift register 201 of Embodiment 1. That is, changes in the electric potential of the node $S_a$ of the flip-flop 400 are the same as those of the sampling pulse (sam) shown in FIG. 1 of Embodiment 1.

The outputs of flip-flops of the adjacent two steps are connected to the logic circuit 405 of each step; however, in the timing chart of FIG. 6, a case in which a pulse is taken from the node $S_b$ from the flip-flop 400 of the previous step and a pulse is taken from the node $S_a$ from the flip-flop 400 of the subsequent step is shown. In the logic circuit 405, the NAND of two pulses that are input is taken and input to the buffer 404 as the sampling pulse (sam) and then input to the switch 403 after being inverted by the buffer 404.

In the present embodiment, differing from Embodiment 1, the duty ratio of the clock signal (CK1) is not 50%, and either the length of the period during which the clock signals (CK1, CK2) are "High" (hereinafter referred to as a "High" period) or the length of the period during which the clock signals (CK1, CK2) are "Low" (hereinafter referred to as a "Low" period) is lengthened by half a period. Furthermore, the clock signal (CK1) and the clock signal (CK2) are input with the phase of one of the two clock signals lagging behind the phase of the other.

The clock signals (CK1, CKB1, CK2, and CKB2) can be generated by modulation of standard clock signals whose duty ratio is 50% (pulse width is half a period). The "High" period or "Low" period of each of the clock signals (Ck1, CK2) is modulated as shown in FIG. 6 and input to the source line driver circuit, and the NAND of a pulse output from the flip-flop 400 is taken by the logic circuit 405, whereby the sampling pulse (sam) with a pulse width equal to the width of the longer of the "Low" period or "High" period (the one whose pulse width is longer) of the clock signals (CK1, CK2) can be taken. As a result, the writing period T of the sampling pulse (sam) is longer than half the period and shorter than a full period of the clock signals (CK1, CK2).

As a result, by the logic circuits 405 of odd-numbered steps, synchronized with the clock signal (CK1), a pulse with a pulse width equal to that of the "Low" period of the first clock signal is generated as the sampling pulse (sam) of odd-numbered steps. In addition, by the logic circuits 405 of even-numbered steps, synchronized with the clock signal (CK2), a pulse with a pulse width equal to that of the "High" period of the second clock signal is generated as the sampling pulse (sam) of even-numbered steps.

It is to be noted that because a NAND circuit is used for the logic circuit 405, in order that the electric potential of the sampling pulse (sam) output from the logic circuit 405 come to be at a "Low" level, the sampling pulse (sam) is inverted by the buffer 404 and input to the switch 403. In FIG. 6, the sampling pulse (sam) that is input to the switch 403 is shown.

In the shift register 401 and the shift register 402, as with the sampling pulse (sam) of Embodiment 1, the pulse width of a pulse output from the flip-flop 400 of each step is longer than one full period of the clock signal, or, alternatively, for every delay of one step, the finishing period of each of the pulses is delayed by the length of a period equal to the longer of the "Low" period or "High" period of the clock signals (CK1, CK2). That is, in the pulses output from the flip-flops 400 of adjacent steps, there is a period in which the pulses do not overlap with each other. In the source line driver circuit of the present embodiment, by performance of logic operations by the logic circuit 405 on the pulse output from the two adjacent flip-flops 400, a portion in which the two pulses do not overlap can be taken for the sampling pulse (sam).

In the source line driver circuit of the present embodiment, as shown in the timing chart of FIG. 6, by input of the start pulse (SP) and the clock signals (CK1, CK2), a pulse with a pulse width equal to the width of the longer of the "Low" period or "High" period of the clock signals can be taken from the output of the flip-flop 400 for the sampling pulse (sam), and the width of all of the sampling pulses (sam) can be set to be longer than half a period of the clock signals (CK1, CK2) and shorter than a full period thereof.

It goes without saying that, by transistor characteristics and the like of the shift registers 401 and 402 and the logic circuit 405, because the width of the sampling pulse taken from the logic circuit 405 is the same width as that of the longer of the "Low" period or "High" period of the clock signals, a delay develops, but the present invention includes this kind of case, as well. As described above, by performance of logic operations by the logic circuit 405 on the pulse output from the two adjacent flip-flops 400, because a portion in which the two pulses do not overlap can be taken for the sampling pulse (sam), the longer of the "Low" period or "High" period of either of the clock signals (CK1, CK2) can be set as a reference for the pulse width of the sampling pulse (sam).

In addition, in the source line driver circuit of the present embodiment, by the sampling pulse (sam) being taken alternatingly from the shift register 401 and the shift register 402, adjacent sampling pulses (sam) overlap with each other so that the writing starting period of the subsequent step and the writing finishing period of the previous step do not overlap. Consequently, by overlapping of the sampling pulses (sam), the generation of noise in the source lines can be eliminated.

The video signal (VIDEO) is input to the video signal line 410 in accordance with the arrangement of the source lines. The writing starting period of the sampling pulse (sam) lags behind the clock signals (CK1, CK2) due to an internal delay in the flip-flop 400. Upon consideration of the delay in the sampling pulse (sam), the video signal (VIDEO) is input to the video signal line 410.

In the source line driver circuit of the present embodiment, as well, the writing period for the sampling pulse (sam) of each step starts before the video signal switches to the video signal that is to be written. The minimum amount of time for switching of the video signal (VIDEO) comes to be half the period of the clock signals (CK1, CK2). In the present embodiment, as well, the writing period $T_a$ during which the video signal that is to be written is written to the source line comes to be half the period of the clock signals (CK1, CK2) and can be synchronized so that it is approximately equal to the period during which the video signals (VIDEO) that are to be written are input to the video signal line 410. Hence, because the maximum amount of time can be used for writing of the video signal (VIDEO) to the source line, the video signal (VIDEO) can be written to the source line most definitely.

In the present embodiment, as well, as in Embodiment 1, the length of the writing period T of the sampling pulse (sam) is longer than the length of the writing period $T_a$ for writing of the video signal that is to be written, and the video signal that is to be written is also written to the source line of the previous row. For this reason, for the display device that includes the source line driver circuit of the present embodiment, as well, as in Embodiment 1, as shown in FIG. 18, in the address storage period τ, the pixel portion 10 is placed in a non-display state; after the address storage period τ ends, the pixel portion 10 is placed in a display state, and gradation is displayed by each pixel according to data that is written.

In the source line driver circuit in FIG. 7, a NAND circuit is used for the logic circuit 405; however, a logic operation circuit other than a NAND circuit can be used. A NOR circuit can also be used for the logic circuit 405. If a NOR circuit is used for the logic circuit 405, the output of the node $S_a$ from the flip-flop 400 of the previous step is input to the logic circuit 405, and the output of the node $S_b$ from the flip-flop 400 of the subsequent step is input to the logic circuit 405. Because the electric potential of the sampling pulse (sam) output from the NOR circuit is "High", either the buffer 404 may be omitted or it may be formed of an even number of inverters connected in series so that the signal that is input is not inverted.

In the source line driver circuit of FIG. 7, the structure may be set to be one in which the switch 403 is turned on when the sampling pulse (sam) is "Low", as well. When a NAND circuit is used for the logic circuit 405, either the buffer 404 may be omitted or it may be formed of an even number of inverters connected in series so that the signal that is input is not inverted and output. In addition, when a NOR circuit is used for the logic circuit 405, the buffer 404 may be formed of an odd number of inverters connected in series so that the signal that is input is inverted and output.

In this way, in the source line driver circuit of FIG. 7, the logic of the switch 403, the buffer 404, and the logic circuit 405 may be determined in accordance with the pulse input to the logic circuit 405 from the flip-flop 400.

Embodiment 3

In Embodiment 1, a source line driver circuit (refer to FIG. 2) in which the number of video signal lines is set to be one line is described. In the present embodiment, an example in which the number of the video signal lines in the source line driver circuit of Embodiment 1 is set to be k number of lines (where k is an integer greater than or equal to 2) will be described.

Figure 11:
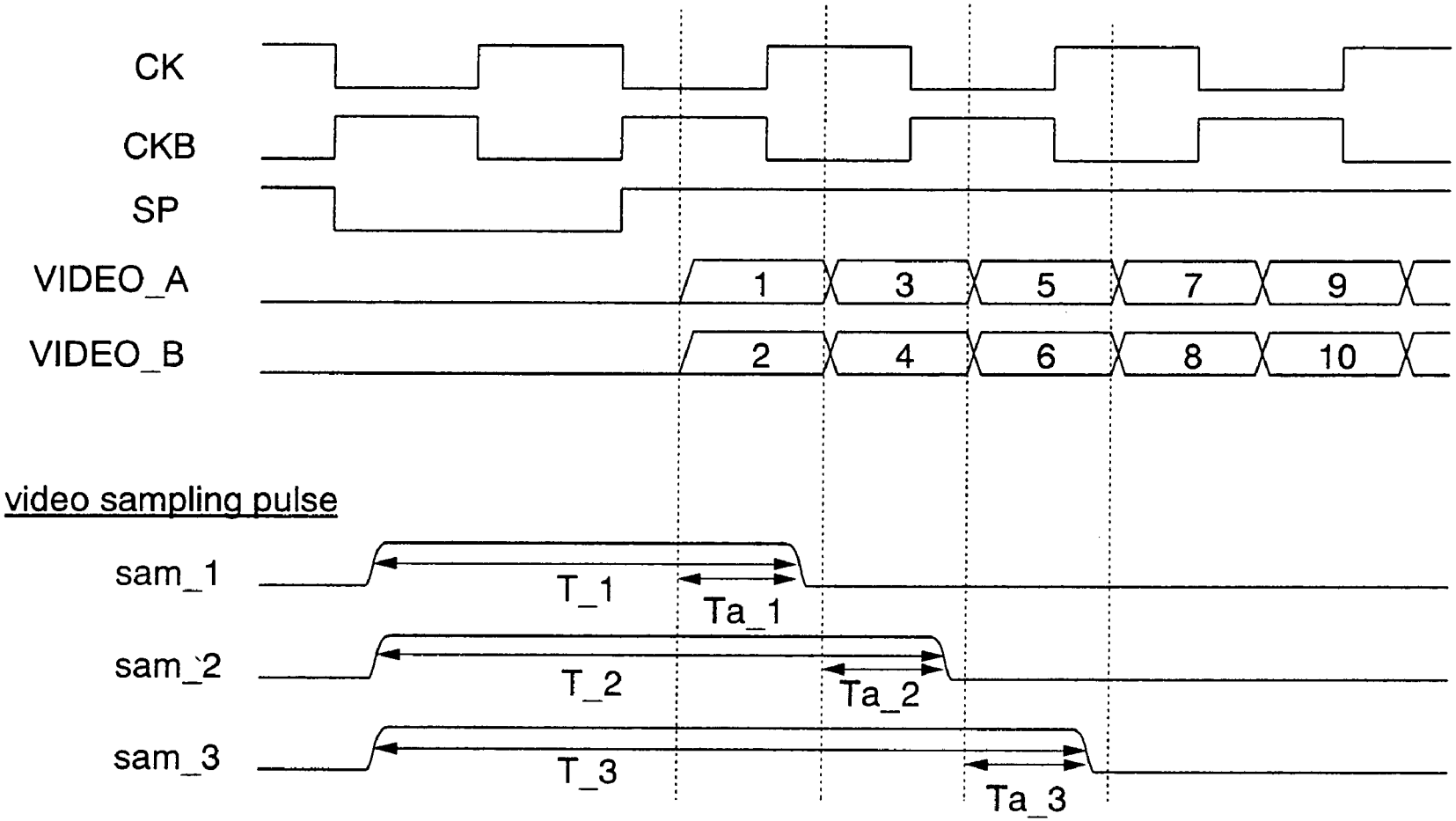
FIG. 11 is a timing chart for input signals and output signals of a source line driver circuit of Embodiment 3.
Figure 12:
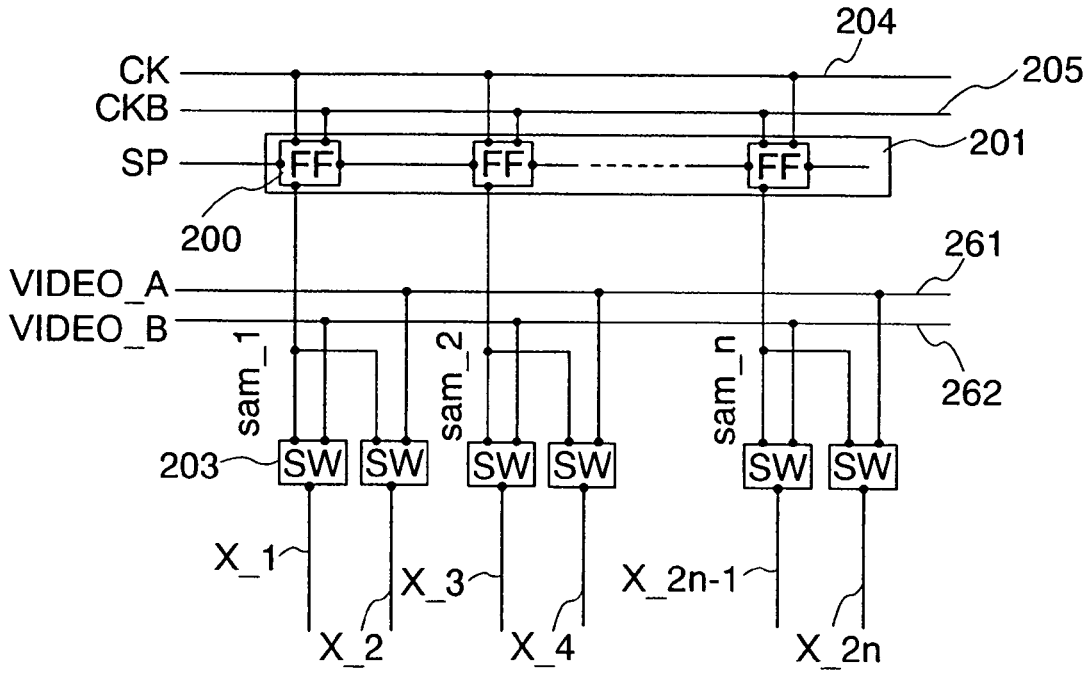
FIG. 12 is a block diagram of the source line driver circuit of Embodiment 3.

In FIG. 12, a block circuit diagram of the source line driver circuit of the present embodiment is shown. In FIG. 12, an example in which the video signal is divided into two signals (k=2) is shown. In FIG. 11, a timing chart of the source line driver circuit of FIG. 12 is shown.

Hereinafter, a modification from what is given in Embodiment 1 will be described. As shown in FIG. 12, in the source line driver circuit of the present embodiment, the two lines into which the video signal line is divided include a video signal line 261 to which a video signal (VIDEO_A) is input and a video signal line 262 to which another video signal (VIDEO_B) is input. The video signal (VIDEO_A) is made up of video signals (VIDEO_1, _3, _5 . . . ) arranged at every second step starting from the first step, and the video signal (VIDEO_B) is made up of video signals (VIDEO_2, _4, _6 . . . ) arranged at every second step starting from the second step. Furthermore, switching back and forth between the video signals (VIDEO_A, VIDEO_B) occurs at half the period of the clock signals (CK, CKB).

Two of the switches 203 are connected to the output of one of the flip-flops 200. The two switches 203 that are connected to the output of the same flip-flop 200 are each connected to a different one of the video signal lines 261 and 262.

As shown in FIG. 11, the sampling pulse (sam) generated by the shift register 201 is the same as that of Embodiment 1. In the present embodiment, writing of the two adjacent source lines X_1 and X_2 is controlled by the sampling pulse (sam_1) of the first step, writing of the two adjacent source lines X_3 and X_4 is controlled by the sampling pulse (sam_2) of the second step, and writing of the two adjacent source lines X_(2n−1) and X_(2n) is controlled by the sampling pulse (sam_n) of the n-th step.

As a result, if the video signal line is set to be two lines, there is no shortening of the writing period $T_a$ of writing to the source line, and the number of source lines, which is to say, the number of pixels in the horizontal direction, can be doubled.

If the video signals are divided k number of times into k number of video signal lines (the number of video signal lines is k number of lines), a video signal arranged at every k-th video signal starting from the i-th video signal is input to the i-th (where i is an integer greater than or equal to 1 and less than or equal to k) video signal line. For example, the video signal (VIDEO_1), the video signal (VIDEO_(1+k)), and the video signal (VIDEO_(1+2k)) are input to the first video signal line, in order.

A k number of the switches 203 are connected to the output of one of the flip-flops 200. The k number of the switches 203 that are connected to the output of the same flip-flop 200, in other words, the k number of the switches 203 that are controlled by the same sampling pulse (sam), are each connected to a different video signal line. Furthermore, as with the source line driver circuit of FIG. 4, in the source line driver circuit of FIG. 12, as well, the output of the flip-flop 200 can be connected to the buffer (Buff) 209 and the sampling pulse (sam) can be input to the switches 203 via the buffer 209, as well.

By the video signal line being set to be k number of lines, there is no shortening of the writing period $T_a$ of writing to the source line, and the number of source lines, which is to say, the number of pixels in the horizontal direction, can be increased by k times.

Embodiment 4

In Embodiment 2, an example is described in which the video signal line is set to be one line in the source line driver circuit (refer to FIG. 7). In the present embodiment, an example in which the video signal line is set to be a k (where k is an integer greater than or equal to 2) number of lines in the source line driver circuit of Embodiment 2 will be described.

Figure 13:
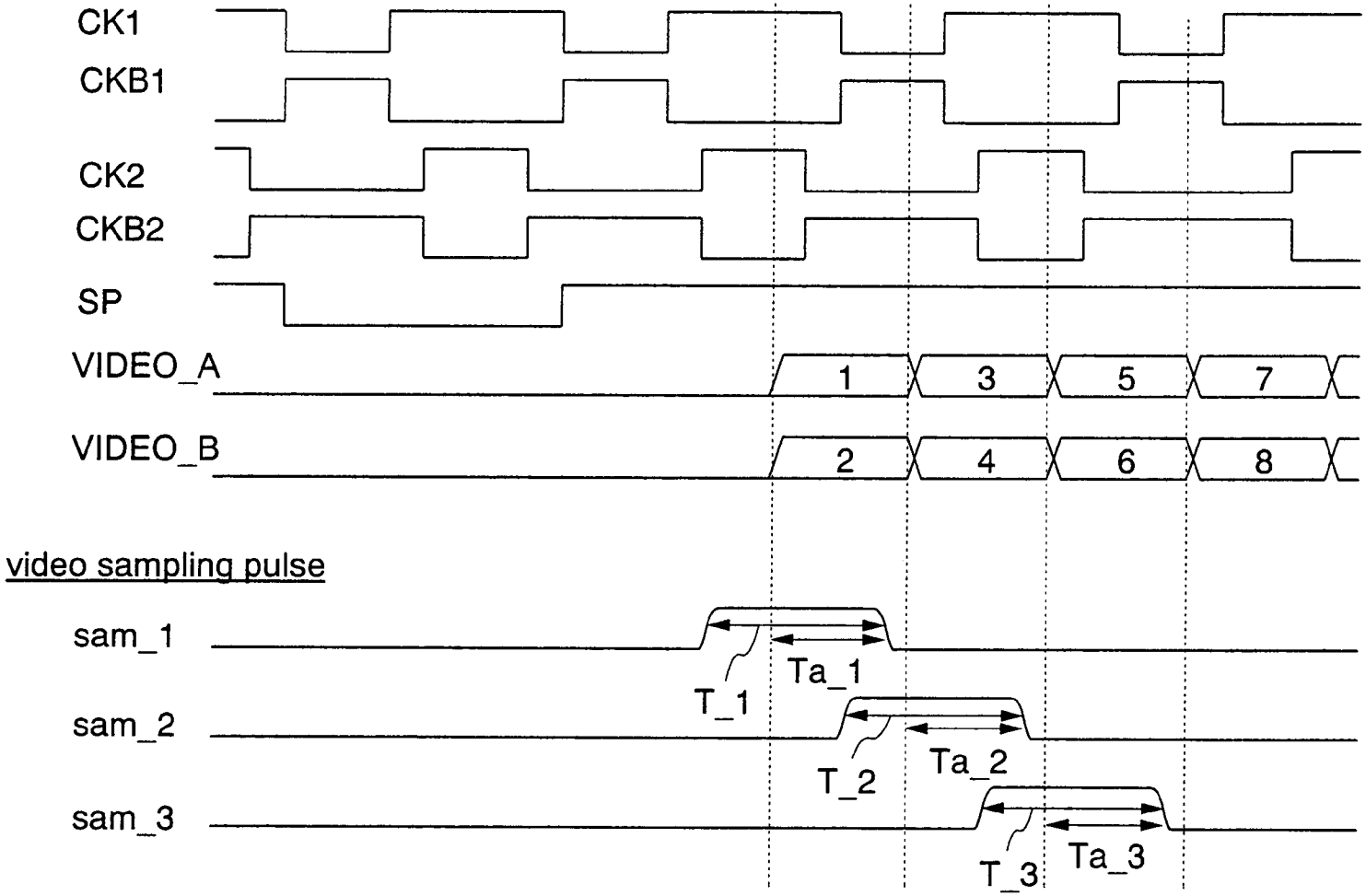
FIG. 13 is a timing chart for input signals and output signals of a source line driver circuit of Embodiment 3.
Figure 14:
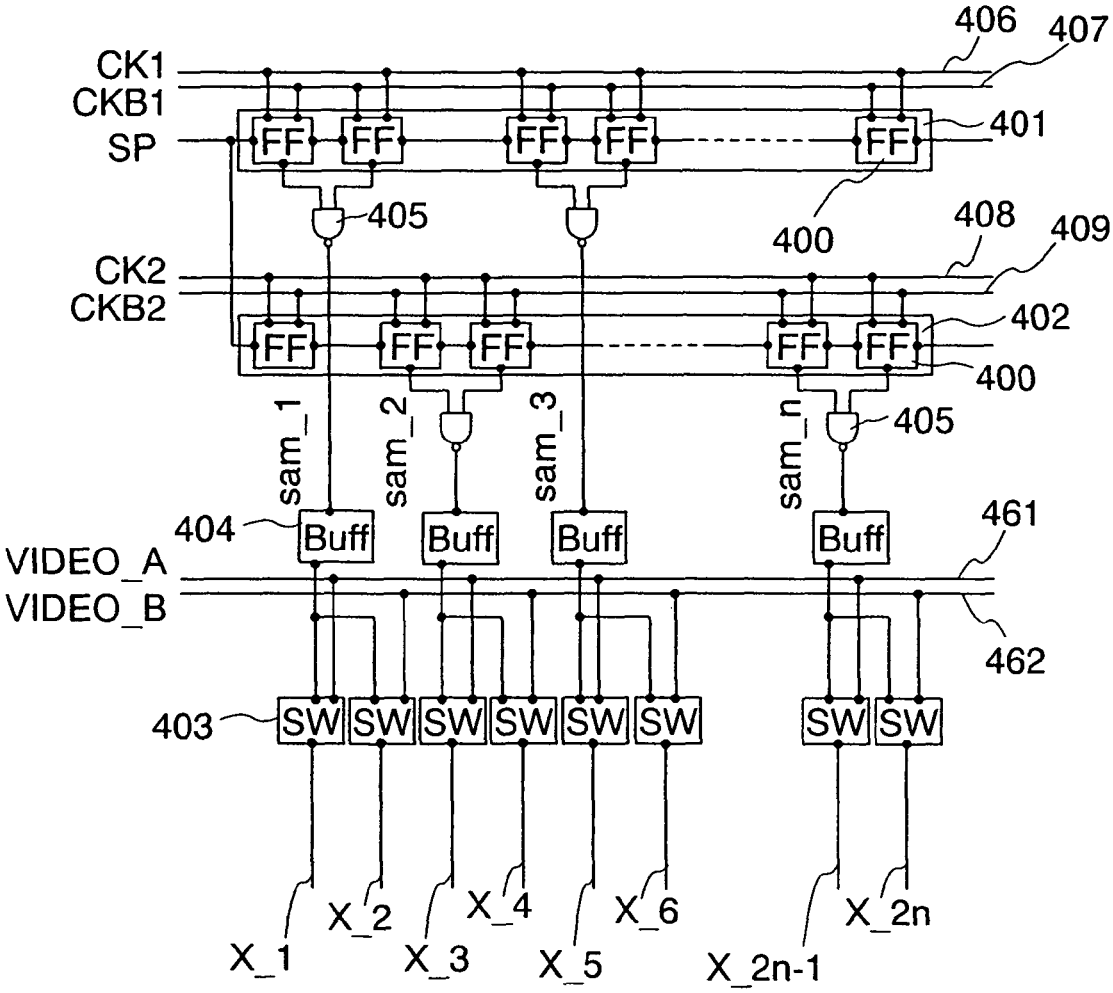
FIG. 14 is a block diagram of the source line driver circuit of Embodiment 4.

In FIG. 14, a block circuit diagram of the source line driver circuit of the present embodiment is shown. In FIG. 14, an example is shown in which the video signal is divided into 2 signals (k=2). In FIG. 13, a timing chart for the source line driver circuit of FIG. 14 is shown.

Hereinafter, a modification from what is given in Embodiment 2 will be described. As shown in FIG. 14, the two lines into which the video signal line is divided include a video signal line 461 to which another video signal (VIDEO_A) is input and a video signal line 462 to which a video signal (VIDEO_B) is input. The video signal (VIDEO_A) is made up of video signals (VIDEO_1, _3, _5 . . . ) arranged at every second step starting from the first step, and the video signal (VIDEO_B) is made up of video signals (VIDEO_2, _4, _6 . . . ) arranged at every second step starting from the second step. Furthermore, as in Embodiment 3, switching back and forth between the video signals (VIDEO_A, VIDEO_B) occurs at half the period of the clock signals (CK, CKB).

In addition, the buffer 404 is connected to the output of the logic circuit 405; however, in the present embodiment, two of the switches 403 are connected to the output of one of the logic circuits 405 (buffers 404). The two switches 403 that are connected to the output of the same logic circuit 405 (buffer 404) are each connected to a different one of the video signal lines 461 and 462. FIG. 13 is a timing chart for when, as in Embodiment 2, a NAND circuit is used for the logic circuit 405. Of course, in the present embodiment, as well, as in Embodiment 2, any logic operation circuit other than a NAND circuit can be used. A NOR circuit can also be used for the logic circuit 405. If a NOR circuit is used for the logic circuit 405, the output of the node $S_a$ from the flip-flop 400 of the previous step is input to the logic circuit 405, and the output of the node $S_b$ from the flip-flop 400 of the subsequent step is input to the logic circuit 405. Because the electric potential of the sampling pulse (sam) output from the NOR circuit is "High", either the buffer 404 may be omitted or it may be formed of an even number of inverters connected in series so that the signal that is input is not inverted and output.

The sampling pulse (sam) generated by the source line driver circuit of the present embodiment is the same as that of Embodiment 2. In the present embodiment, writing of the two adjacent source lines X_1 and X_2 is controlled by the sampling pulse (sam_1) of the first step, writing of the two adjacent source lines X_3 and X_4 is controlled by the sampling pulse (sam_2) of the second step, and writing of the two adjacent source lines X_(2n−1) and X_(2n) is controlled by the sampling pulse (sam_n) of the n-th step.

As a result, if the video signal line is set to be two lines, there is no shortening of the writing period $T_a$ of writing to the source line, and the number of source lines can be doubled, that is, the number of pixels in the horizontal direction can be doubled.

If the video signals are divided k number of times into k number of signals of video signals (the number of video signal lines is divided into k number of lines), the i-th (where i is an integer greater than or equal to 1 and less than or equal to k) video signal line inputs a video signal arranged at every k-th video signal starting from the i-th video signal. For example, the video signal (VIDEO_1), the video signal (VIDEO_(1+k)), and the video signal (VIDEO_(1+2k)), are input to the first video signal line in order.

A k number of the switches 403 are connected to the output of one of the logic circuits 405 (buffers 404). The k number of the switches 403 that are connected to the same logic circuit 405 (buffer 404), in other words, the k number of the switches 403 that are controlled by the same sampling pulse (sam), are each connected to a different video signal line. By the video signal line being set to be k number of lines, there is no shortening of the writing period $T_a$ of writing to the source line, and the number of source lines can be increased by k times, that is, the number of pixels in the horizontal direction can be increased by k times.

Embodiment 5

In the source line driver circuits of Embodiment 2 and Embodiment 4, by performance of logic operations by the logic circuit 405 on pulses output from two adjacent flip-flops 400, because portions in which the two pulses do not overlap with each other are taken for the sampling pulse (sam), not only can the writing period T (pulse width) of the sampling pulse (sam) be set to be the longer of the "High" period or "Low" period of the clock signals (CK1, CK2) but the shorter of the "High" period or "Low" period of the clock signals (CK1, CK2) can also be set as the reference. In the timing charts of FIG. 6 and FIG. 13, by modification of the input waveforms of the clock signals (CK1, CK2), the shorter of the "High" period or "Low" period of the writing period T of the sampling pulse (sam) (the "High" period or "Low" period of the clock signals (CK1, CK2)) can be set as the reference.

Consequently, in the source line driver circuits of Embodiment 2 and Embodiment 4, by the "High" period or "Low" period of the clock signals (CK1, CK2) being changed, the writing period T of the sampling pulse (sam) can be changed within a range smaller than one full period of the clock signal (CK1, CK2).

By the shorter of the "High" period or "Low" period of the clock signals (CK1, CK2) being set as the reference and the sampling pulse (sam) being generated, because the length of the writing period T is shorter than half of the period of the clock signal, the sampling pulse can be generated without any overlap between adjacent pulses. In this case, as in a conventional driving method of an active matrix type display device, the address storage period $\tau$ can overlap with the display period $T_{dis}$.

In this way, the source line driver circuits of Embodiment 2 and Embodiment 4 are circuits that have an extremely high amount of versatility and circuits in which, without any change in circuit structure, by the duty ratio of the reference clock signal being changed, both sampling pulses that overlap with each other (generation with overlap) and sampling pulses that do not overlap with each other (generation without overlap) can be generated.

Embodiment 6

In the present embodiment, electronic devices each equipped with an active matrix type display device of the present invention for the display means will be described. For electronic devices that use the display device of the present invention, television sets; cameras such as video cameras, digital cameras, and the like; goggle displays; navigation systems; audio playback devices (car audio components and the like); computers; game machines; handheld terminals (portable computers, cellular phones, portable game devices, e-book readers, and the like); image playback devices provided with storage media (specifically, devices that can play audio data stored in storage media such as DVDs (digital versatile discs) and the like and that include a display that can display the images); and the like can be given.

By use of the active matrix type display device of the present invention in a variety of electronic devices, images can be displayed at high definition. Hereinafter, using FIGS. 22A to 22E and FIG. 23, specific examples of these kinds of electronic devices will be described.

Figure 22A:
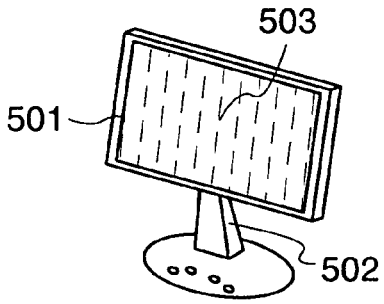
FIGS. 22A to 22E are representations of the exterior of electronic devices that are each equipped with the active matrix type display device of the present invention.

FIG. 22A is a diagram of a TV device that has a chassis 501, a support stand 502, a display 503, and the like. In this TV device, an active matrix type display device that has a source line driver circuit of any of Embodiment 1 through Embodiment 5 is used for the display 503.

Figure 22B:
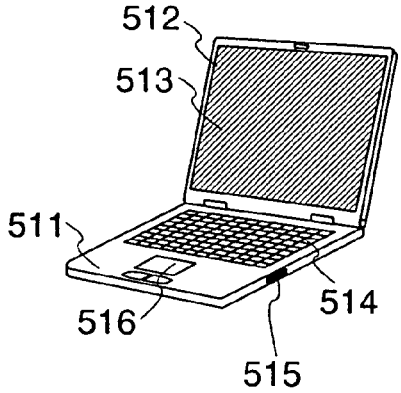

FIG. 22B is a diagram of a laptop computer that has a main body 511, a chassis 512, a display 513, a keyboard 514, an external connection port 515, a pointing device 516, and the like. For the display 513 of this notebook computer, an active matrix type display device that has a source line driver circuit of any of Embodiment 1 through Embodiment 5 is used.

Figure 22C:
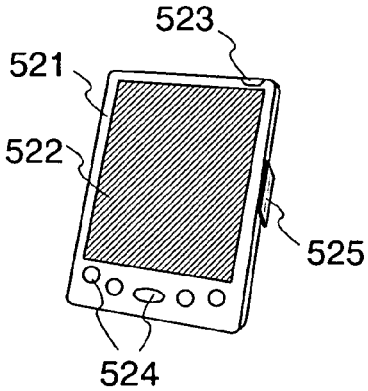

FIG. 22C is a diagram of a mobile computer that has a main body 521, a display 522, a switch 523, operation keys 524, an infrared port 525, and the like. For the display 522 of this mobile computer, an active matrix type display device that has a source line driver circuit of any of Embodiment 1 through Embodiment 5 is used.

Figure 22D:
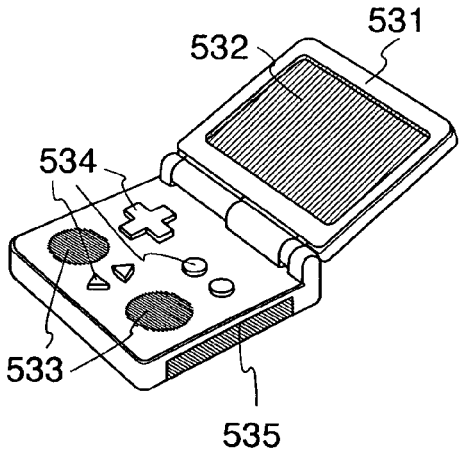

FIG. 22D is a diagram of a handheld game device that has a chassis 531, a display 532, speakers 533, operation keys 534, a storage media insertion slot 535, and the like. For the display 532 of this handheld game device, an active matrix type display device that has a source line driver circuit of any of Embodiment 1 through Embodiment 5 is used.

Figure 22E:
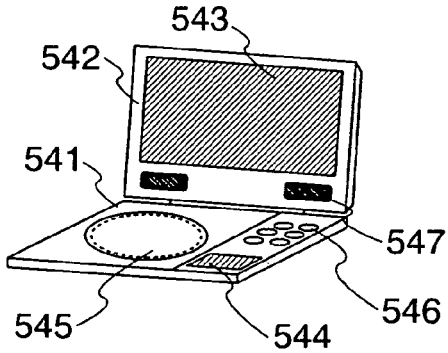

FIG. 22E is a diagram of a portable image playback device (specifically, a DVD player), which is provided with storage media, and has a main body 541, a chassis 542, a display 543, a display 544, a storage media reader (for DVDs or the like) 545, operation keys 546, speakers 547, and the like. The display 543 displays mainly image information, and the display 544 displays mainly textual information. For at least one of the display 543 and the display 544 of this portable image playback device, an active matrix type display device that has a source line driver circuit of any of Embodiment 1 to Embodiment 5 is used. In particular, the present invention is well suited for the display 543 for display of image information.

Figure 23:
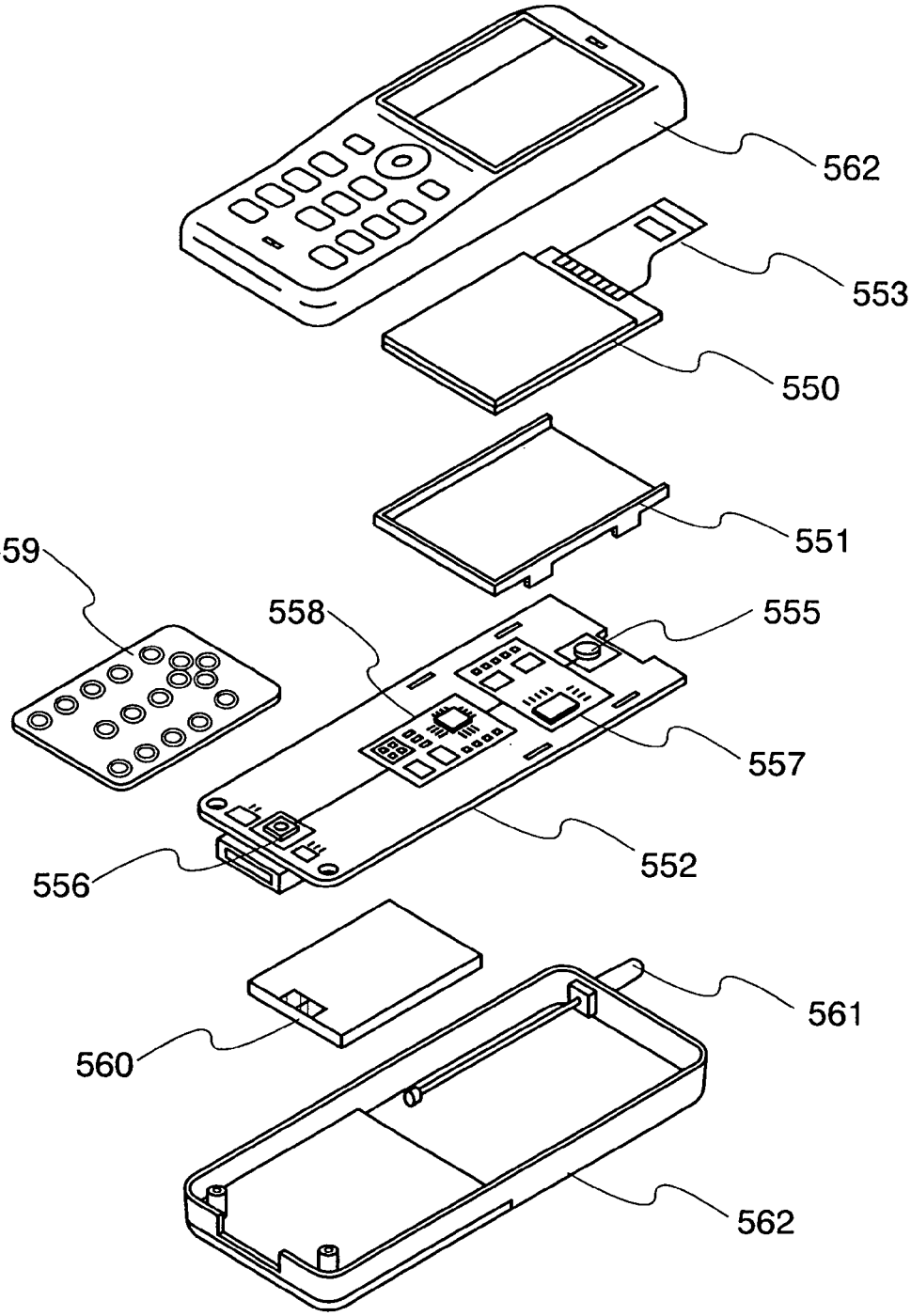
FIG. 23 is an exploded perspective diagram of a cellular phone equipped with the active matrix type display device of the present invention.

FIG. 23 is an exploded perspective diagram of a cellular telephone. For a display module 550, an active matrix type display device that has a source line driver circuit of any of Embodiment 1 through Embodiment 5 is used. The display module 550 is detachably incorporated into a housing 551. The shape and dimensions of the housing 551 can be modified as appropriate to fit the size of the display module 550. A printed circuit board 552 can be placed in the housing 551 to which the display module 550 is affixed.

The display module 550 is connected to the printed circuit board 552 via an FPC 553. A speaker 555; a microphone 556; a transmitting and receiving circuit 557; and a signal processing circuit 558 that has a CPU, a controller, and the like are attached to the printed circuit board 552. This display module 550 and the like are combined with an input means 559, a battery 560, and an antenna 561 and housed in a chassis 562. The pixel portion of the display module 550 is arranged so that they can be seen from an aperture window formed in the chassis 562.

This application is based on Japanese Patent Application serial No. 2006-280535 filed with the Japan Patent Office on Oct. 13, 2006, the entire contents of which are hereby incorporated by reference.

The invention claimed is:

1. A source line driver circuit of an active matrix type display device comprising:

scanning lines;

source lines intersecting with the scanning lines;

a pixel portion including a plurality of pixels connected to the scanning lines and the source lines;

a k (where k is an integer greater than or equal to 2) number of video signal lines to which video signals divided into a k number of signals are input;

a first shift register that generates and outputs a plurality of first pulses, where a start pulse signal and a first clock signal are input to the first shift register, a writing starting period is synchronized with the start pulse signal, and writing finishing periods are delayed sequentially in accordance with the first clock signal;

a second shift register that generates and outputs a second pulse, where the start pulse and a second clock signal, a period thereof being the same as a period of the first clock signal but a phase thereof being delayed, are input to the second shift register, a writing starting period is synchronized with the start pulse, and writing finishing periods are delayed sequentially in accordance with the second clock signal;

a plurality of logic circuits, which perform logic operations on two adjacent first pulses of odd-numbered steps, where the logic circuits output portions in which the two first pulses do not overlap as sampling pulses of odd-numbered steps, and which perform logic operations on two adjacent second pulses of even-numbered steps, where the logic circuits output portions in which the two second pulses do not overlap as sampling pulses of even-numbered steps;

a plurality of switches to which the source lines are connected and by which the source lines and the video signal lines conduct between each other in accordance with the sampling pulse, wherein a k number of the switches are connected to an output of the logic circuit, and wherein the k number of the switches connected to the same logic circuit are each connected to a different video signal line.

2. The source line driver circuit according to claim 1, wherein either a period during which the first clock signal and the second clock signal become high or a period during which the first clock signal and the second clock signal become low is longer than the other period.

3. The source line driver circuit according to claim 1, wherein a writing period of the sampling pulse changes by changing a duty ratio of the first clock signal and the second clock signal.

4. A source line driver circuit of an active matrix type display device comprising:

scanning lines;

source lines intersecting with the scanning lines;

a pixel portion including a plurality of pixels connected to the scanning lines and the source lines;

a k (where k is an integer greater than or equal to 2) number of video signal lines to which video signals divided into a k number of signals are input;

a first shift register, to which a start pulse signal and a first clock signal are input, comprising flip-flops of a plurality of steps;

a second shift register, to which the start pulse signal and a second clock signal, a period thereof being the same as a period of the first clock signal but a phase thereof being delayed, are input, comprising flip-flops of a plurality of steps;

a plurality of logic circuits, which output sampling pulses; and a plurality of switches to which the source lines are connected and by which the source lines and the video signal lines conduct between each other in accordance with the sampling pulse, wherein each of the flip-flops of the first shift register and each of the flip-flops of the second shift register comprises:

a p-type transistor and a first n-type transistor, where a gate of the p-type transistor and a gate of the first n-type transistor are connected to an input of the flip-flop and the p-type transistor and the first n-type transistor are connected in series;

a second n-type transistor connected to the first n-type transistor in series, where a clock signal is input to a gate of the second n-type transistor; and an inverter, where an input of the inverter is connected to a drain of the p-type transistor and a drain of the first n-type transistor and an output of the inverter is connected to the output of the flip-flop, wherein, in the first shift register and in the second shift register, the start pulse signal is input to the input of the flip-flop of the first step and the output of the inverter of the flip-flop of a previous step is input to the flip-flop of the second step and subsequent steps, wherein the output of the flip-flop is any one of the output of the inverter, the output of the drain of the p-type transistor, and the output of the drain of the first n-type transistor, wherein outputs of two adjacent flip-flops of the first shift register are connected to inputs of the logic circuits of odd-numbered steps, wherein outputs of two adjacent flip-flops of the second shift register are connected to inputs of the logic circuits of even-numbered steps, wherein the k number of switches are connected to outputs of the logic circuits, and wherein the k number of the switches connected to the same logic circuit are each connected to a different video signal line.

5. The source line driver circuit according to claim 4, wherein the flip-flop comprises a clocked inverter where an input of the clocked inverter is connected to the output of the inverter, an output of the clocked inverter is connected to the output of the drain of the p-type transistor and the output of the drain of the first n-type transistor.

6. The source line driver circuit according to claim 4, wherein the flip-flop comprises a storage capacitor to retain an electric potential of the output of the drain of the p-type transistor and an electric potential of the output of the drain of the first n-type transistor.

7. The source line driver circuit according to any one of claims 1 and 4, further comprising a plurality of buffers, wherein the sampling pulse is input to the switch via the buffer.

8. The source line driver circuit according to any one of claims 1 and 4, wherein the first logic circuit and the second logic circuit are NAND circuits.

9. The source line driver circuit according to any one of claims 1 and 4, wherein the first logic circuit and the second logic circuit are NOR circuits.

10. The source line driver circuit according to any one claims 1 and 4, wherein the source line driver circuit is incorporated in an active matrix liquid crystal display device.

11. The source line driver circuit according to any one claims 1 and 4, wherein the source line driver circuit is incorporated in a field sequential system active matrix liquid crystal display device.

12. The source line driver circuit according to any one claims 1 and 4, wherein the source line driver circuit is incorporated in an active matrix electroluminescent display device.

13. The source line driver circuit according to any one claims 1 and 4, wherein the source line driver circuit is incorporated in one selected from the group consisting of a TV device, a laptop computer, a mobile computer, a game device, an image play back device, and a cellular phone.

* * * * *